US008870179B2

(12) United States Patent
Shiraishi et al.

(10) Patent No.: US 8,870,179 B2
(45) Date of Patent: Oct. 28, 2014

(54) PAPER FEED DEVICE AND IMAGE FORMING APPARATUS PROVIDED WITH THE SAME

(71) Applicant: Sharp Kabushiki Kaisha, Osaka (JP)

(72) Inventors: Yoshinori Shiraishi, Osaka (JP); Yasuaki Fukada, Osaka (JP); Masaru Tsuji, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/674,167

(22) Filed: Nov. 12, 2012

(65) Prior Publication Data

US 2013/0127108 A1 May 23, 2013

(30) Foreign Application Priority Data

Nov. 17, 2011 (JP) ..... 2011-251830

(51) Int. Cl.

| | |
|---|---|
| ***B65H 7/02*** | (2006.01) |
| ***B65H 1/08*** | (2006.01) |
| ***B65H 5/22*** | (2006.01) |
| ***B65H 3/12*** | (2006.01) |
| ***B65H 1/14*** | (2006.01) |
| ***B65H 3/54*** | (2006.01) |
| ***B65H 3/48*** | (2006.01) |
| ***B65H 3/00*** | (2006.01) |
| ***B65H 3/08*** | (2006.01) |
| ***B65H 3/06*** | (2006.01) |

(52) U.S. Cl.

CPC ..... *B65H 3/00* (2013.01); *B65H 2405/332* (2013.01); *B65H 2801/03* (2013.01); *B65H 2405/15* (2013.01); *B65H 1/08* (2013.01); *B65H 2511/212* (2013.01); *B65H 5/222* (2013.01); *B65H 3/128* (2013.01); *B65H 1/14* (2013.01); *B65H 3/54* (2013.01); *B65H 2511/22* (2013.01); *B65H 2511/20* (2013.01); *B65H 3/48* (2013.01); *B65H 3/08* (2013.01); *B65H 3/06* (2013.01)

USPC ..... 271/31; 271/104; 271/171; 271/98

(58) Field of Classification Search

USPC ..... 271/104, 167, 169, 170, 171, 97, 31, 271/145

See application file for complete search history.

(56) References Cited

U.S. PATENT DOCUMENTS 5,876,030 A * 3/1999 Dobbertin et al. ..... 271/13
5,893,554 A * 4/1999 Okahashi et al. ..... 271/98

(Continued)

FOREIGN PATENT DOCUMENTS

JP 03-284546 12/1991
JP 2010-058917 3/2010

*Primary Examiner* — Ernesto Suarez

(74) *Attorney, Agent, or Firm* — Renner, Otto, Boisselle & Sklar, LLP

(57) ABSTRACT

A paper feed device includes a paper stacking shelf, a paper trailing edge guide that regulates a position of a paper bundle, a contact member that is disposed on the paper trailing edge guide, and a position switch portion that moves the contact member to either a withdrawn away position or a contact position with respect to an upper face of the paper bundle. The position switch portion is provided with a rod that is moved in conjunction with an operation for causing the paper feed device to be pulled out from and pushed into the accommodation space, and a rotatable member that is rotated in conjunction with the movement of the rod. The position switch portion supports the contact member, and causes the contact member to be rotationally moved to either the withdrawn away position or the contact position in conjunction with the rotation of the rotatable member.

26 Claims, 17 Drawing Sheets

(56) References Cited

U.S. PATENT DOCUMENTS

| | | | | |
|---|---|---|---|---|
| 5,944,307 | A * | 8/1999 | Yim | 271/170 |
| 6,916,019 | B2 * | 7/2005 | Takahashi | 271/145 |
| 7,677,553 | B2 * | 3/2010 | Ikeda | 271/98 |
| 8,172,219 | B2 * | 5/2012 | Matsumoto | 271/93 |
| 8,262,080 | B2 * | 9/2012 | Matsumoto et al. | 271/98 |
| 8,419,008 | B2 * | 4/2013 | Ikeda et al. | 271/31 |
| 8,439,349 | B2 * | 5/2013 | Matsumoto et al. | 271/97 |
| 8,490,965 | B2 * | 7/2013 | Ueda et al. | 271/98 |

* cited by examiner

PAPER FEED DEVICE AND IMAGE FORMING APPARATUS PROVIDED WITH THE SAME

CROSS-REFERENCE TO RELATED APPLICATION

This application claims priority under 35 U.S.C. §119(a) on Patent Application No. 2011-251830 filed in Japan on Nov. 17, 2011, the entire contents of which are herein incorporated by reference.

TECHNICAL FIELD

The present invention relates to a paper feed device that draws out and sends out paper from a paper bundle stacked on a paper stacking shelf, and an image forming apparatus provided with this paper feed device.

BACKGROUND ART

As an example of this type of paper feed device, there is a device including a paper stacking shelf on which a paper bundle is to be stacked, a paper transport belt that is disposed above the paper stacking shelf, and a fan that sucks air through air through holes of the paper transport belt, wherein an uppermost sheet of paper in the paper bundle is transported while being caused to adhere to the paper transport belt by sucking air through the air through holes of the paper transport belt.

Furthermore, in such a paper feed device, in order to stabilize the operation that causes an uppermost sheet of paper in the paper bundle to adhere to the paper transport belt, it is necessary to position the uppermost sheet of paper in the paper bundle at a proper height. Accordingly, a trailing edge portion (a paper edge portion that is oriented in a direction opposite to the paper transport direction) of paper in the paper bundle is pressed down so as to prevent the trailing edge portion of paper from moving upward, and a sensor that detects whether or not the upper face of the paper bundle is at a proper height is provided so the paper stacking shelf is lifted until it is detected that the upper face of the paper bundle has reached the proper height, for example.

For example, a paper feed tray device of Patent Document 1 includes a regulating member that regulates the position of a trailing edge of a paper bundle by being brought into contact with the trailing edge of the paper bundle, and a paper pressing lever that is supported in a rotatable manner on the regulating member, wherein, in a state in which the regulating member is in contact with the trailing edge of the paper bundle, the paper pressing lever is rotated to be brought into contact with a trailing edge portion of an upper face of the paper bundle, so that the trailing edge portion of paper in the paper bundle is prevented from moving upward. Furthermore, a sensor that detects that the paper pressing lever has reached a predetermined rotational position where the upper face of the paper bundle reaches the proper height is provided, and a tray is lifted until the upper face of the paper bundle pushes up the tip end of the paper pressing lever and the sensor detects the paper pressing lever at the predetermined rotational position. Furthermore, when the tray is lowered to the lower limit position, the tray is brought into contact with a tray detection lever and depresses the tray detection lever, a wire connecting the tray detection lever and the paper pressing lever is pulled down, so that the paper pressing lever is rotated to be withdrawn from the upper face of the paper bundle.

[Patent Document 1] JP H3-284546A

SUMMARY OF INVENTION

However, according to the paper feed tray device of Patent Document 1, when stacking and supplying a paper bundle on the tray, unless a main body of the paper feed tray device is pulled out from an image forming apparatus or the like and also the tray is lowered to the lower limit position, the paper pressing lever is not withdrawn from the upper face of the paper bundle, so that a paper bundle cannot be supplied to the tray. That is to say, unless the main body of the paper feed tray device is pulled out and also the tray is lowered to the lower limit position, a paper bundle cannot be supplied to the tray. Moreover, such a supply operation is necessary even when additionally supplying a small amount to a paper bundle, and, thus, it takes time to supply a paper bundle.

The present invention was made in view of such conventional problems, and it is an object thereof to provide a paper feed device in which it is possible not only to prevent paper in a paper bundle from moving upward and to detect that an upper face of the paper bundle has reached a proper height, but also to more quickly supply a paper bundle, and an image forming apparatus provided with this paper feed device.

In order to solve the above-described problems, the present invention is directed to a paper feed device, including: a paper stacking shelf on which a paper bundle is to be stacked; a position regulating portion that regulates a position of the paper bundle by being brought into contact with an edge of the paper bundle; a contact member that is disposed on the position regulating portion; and a position switch portion that moves the contact member to either a withdrawn away position or a contact position with respect to an upper face of the paper bundle; wherein the paper feed device is pulled out from and pushed into an accommodation space for accommodating the paper feed device, the position switch portion is provided with a movable member that is moved in conjunction with an operation for causing the paper feed device to be pulled out from and pushed into the accommodation space, and a rotatable member that is rotated in conjunction with the movement of the movable member, and the position switch portion supports the contact member in a rotatable manner, and causes the contact member to be rotationally moved to either the withdrawn away position or the contact position with respect to the upper face of the paper bundle in conjunction with the rotation of the rotatable member.

In the present invention, the movable member is moved in conjunction with an operation for causing the paper feed device to be pulled out from and pushed into the accommodation space, the rotatable member is rotated in conjunction with the movement of the movable member, and the contact member is rotated in conjunction with the rotation of the rotatable member, so that the contact member is moved to either the withdrawn away position or the contact position with respect to the upper face of the paper bundle. Accordingly, the contact member is moved to the withdrawn away position with respect to the upper face of the paper bundle only with the operation that pulls out the paper feed device from the accommodation space. Furthermore, the contact member is moved to the contact position with respect to the upper face of the paper bundle only with the operation that pushes the paper feed device into the accommodation space. Accordingly, when supplying a paper bundle to the paper feed device, only with the operation that pulls out the paper feed device, the contact member can be moved to the withdrawn away position with respect to the upper face of the paper bundle, and a paper bundle can be supplied. Furthermore, only with the operation that pushes in the paper feed device, the contact member can be moved to the contact position with respect to the upper face of the paper bundle, and paper in the paper bundle can be prevented from moving upward.

Furthermore, the paper feed device of the present invention may further include a biasing member that biases the rotatable member, in a rotational direction of the rotatable member for moving the contact member to the withdrawn away position.

In this case, when the operation that pulls out the paper feed device from the accommodation space is performed, the rotatable member is rotated due to the biasing force of the biasing member, and the contact member is moved to the withdrawn away position in conjunction with the rotatable member.

Furthermore, the paper feed device of the present invention may further include: a first biasing member that biases the contact member in a rotational direction to the contact position; and a second biasing member that biases the rotatable member, in a rotational direction of the rotatable member for moving the contact member to the withdrawn away position.

In this case, when the operation that pulls out the paper feed device from the accommodation space is performed, the rotatable member is rotated due to the biasing force of the second biasing member, and the contact member is moved to the withdrawn away position in conjunction with the rotatable member. Furthermore, when the operation that pushes the paper feed device into the accommodation space is performed, the rotatable member is rotated in reverse resisting the biasing force of the second biasing member, and the contact member is moved to the contact position due to the biasing force of the first biasing member.

For example, in the paper feed device of the present invention, the movable member may be moved upon contact with a member that is disposed in the accommodation space when the paper feed device is pushed into the accommodation space.

Furthermore, in the paper feed device of the present invention, the movable member may be a rod-like member that is linearly moved in conjunction with an operation for causing the paper feed device to be pulled out from and pushed into the accommodation space, the rotatable member may have an elongated recess portion that receives one edge portion of the rod-like member, and the elongated recess portion may be pushed by the one edge portion of the rod-like member, so that the rotatable member is rotated.

For example, in the paper feed device of the present invention, the rotatable member may have a curved portion and an arm portion, when the movable member is moved and the rotatable member is rotated in conjunction with an operation for causing the paper feed device to be pushed into the accommodation space, the contact member may be guided into the curved portion of the rotatable member, and rotated in a rotational direction to the contact position, and a rotational position of the contact member may be regulated by the curved portion of the rotatable member, and when the movable member is moved and the rotatable member is rotated in conjunction with an operation for causing the paper feed device to be pulled out from the accommodation space, the contact member may be pushed up by the arm portion of the rotatable member, and rotated to the withdrawn away position.

Furthermore, in the paper feed device of the present invention, a length across which the contact member is in contact with the upper face of the paper bundle in a direction orthogonal to a transport direction of paper in the paper bundle may be longer than a length across which the contact member is in contact with the upper face of the paper bundle in the transport direction.

Accordingly, paper in the paper bundle is effectively prevented from moving upward.

Furthermore, in the paper feed device of the present invention, the contact member may be provided with a roller that is brought into contact with the upper face of the paper bundle.

In this case, since the roller of the contact member is in contact with an uppermost sheet of paper in the paper bundle, friction between the contact member and the uppermost sheet of paper in the paper bundle is reduced, and the uppermost sheet of paper can be easily drawn out. Furthermore, the roller prevents tilting of paper.

Furthermore, in the paper feed device of the present invention, the contact member may be brought into contact with a trailing edge portion of the upper face of the paper bundle, the trailing edge portion being oriented in a direction opposite to a paper transport direction of paper in the paper bundle.

In this case, the trailing edge portion of paper in the paper bundle is prevented from moving upward.

Furthermore, the paper feed device of the present invention may further include a sensor that detects whether or not the upper face of the paper bundle has reached the contact position. Moreover, the paper feed device of the present invention may further include a vertical movement drive portion that vertically moves the paper stacking shelf, thereby moving the upper face of the paper bundle to the contact position, and the contact position may be located closer to the withdrawn away position than is the position to which the contact member has been rotated through regulation by the curved portion of the rotatable member.

In this case, when the upper face of the paper bundle is lifted and reaches the contact position, the contact member is pushed up by the upper face of the paper bundle from the rotational position to the contact position, and the sensor detects that the upper face of the paper bundle has reached the contact position.

Furthermore, the paper feed device of the present invention may further include a control portion that keeps the vertical movement drive portion in operation to lift the paper stacking shelf until the sensor detects that the upper face of the paper bundle has reached the contact position.

When paper is drawn out from the paper bundle, the height of the upper face of the paper bundle is reduced with respect to the contact position. Thus, when the height becomes lower than the contact position, the paper stacking shelf is lifted until the sensor detects that the upper face of the paper bundle has reached the contact position. The contact position refers to an optimum height for causing paper to be drawn out from the paper bundle, and is determined by factors such as a structure that draws out paper from the paper bundle.

Furthermore, the paper feed device of the present invention may further include: an end face air blow portion that blows air against an end face of the paper bundle; and a paper transport member that transports paper in the paper bundle in a state where the paper adheres thereto due to suction of air; and the contact member may be brought into contact with a trailing edge portion of the upper face of the paper bundle.

When air is blown against an end face of the paper bundle in this manner, this air enters between the sheets of paper in the paper bundle, and, thus, the sheets of paper can be separated. Accordingly, paper in the paper bundle can be transported while being caused to quickly adhere to the paper transport member. Accordingly, a large amount of paper can be fed at high speed. Furthermore, although paper in the paper bundle tends to move upward when air is blown or sucked to separate sheets of paper in the paper bundle or to cause adhesion of paper, paper does not move upward at the trailing edge portion of the paper bundle because the contact member is in contact with the trailing edge portion of the upper face of the paper bundle. Furthermore, the contact position can be stably and accurately detected by the sensor.

Moreover, the present invention is directed to an image forming apparatus that includes the above-described paper feed device of the present invention.

This sort of image forming apparatus of the present invention also achieves actions and effects similar to those of the paper feed device of the present invention.

BRIEF DESCRIPTION OF DRAWINGS

FIGS. 13 (*a*) and 13 (*b*) are a front view and a side view showing the contact member and the position switch portion respectively viewed from a front side and a lateral side, in a state in which the paper feed device is pushed in.

FIG. 14 is a perspective view showing the contact member and the position switch portion viewed obliquely from an upper front side, in a state in which the paper feed device is pushed in.

FIG. 15 is a perspective view showing the contact member and the position switch portion viewed obliquely from a lower front side, in a state in which the paper feed device is pushed in.

DESCRIPTION OF EMBODIMENT

Hereinafter, an embodiment of the present invention will be described in detail with reference to the appended drawings.

Figure 1:
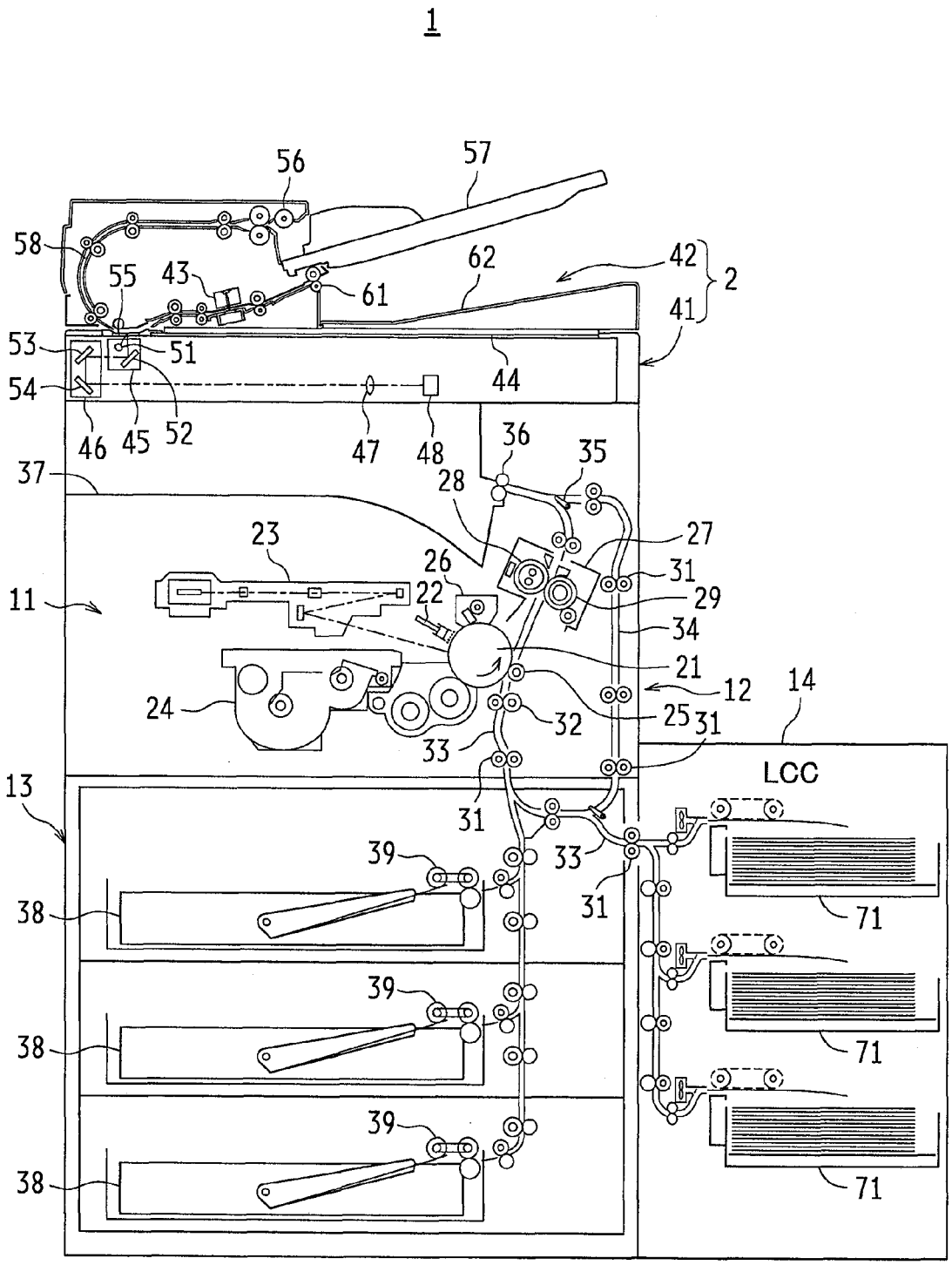
FIG. 1 is a cross-sectional view showing an image forming apparatus to which a paper feed device according to an embodiment of the present invention has been applied.

FIG. 1 is a cross-sectional view showing an image forming apparatus to which a paper feed device according to an embodiment of the present invention has been applied. The configuration of an image forming apparatus 1 is roughly divided into a document reading device 2, a printing portion 11, a paper transport portion 12, a paper feed portion 13, and a large capacity cassette (LCC) 14.

In the printing portion 11, after a cleaning device 26 removes and recovers residual toner on the surface of a photosensitive drum 21, a charging device 22 uniformly charges the surface of the photosensitive drum 21 to a predetermined potential, a laser exposure device 23 exposes the surface of the photosensitive drum 21 to light and forms an electrostatic latent image on that surface, and a development device 24 develops the electrostatic latent image on the surface of the photosensitive drum 21 and forms a toner image on the surface of the photosensitive drum 21.

A transfer roller 25 is pressed against the photosensitive drum 21 to form a nip region between the transfer roller 25 and the photosensitive drum 21, and, while a recording paper that has been transported through a paper transport path 33 is being conveyed through the nip region, transfers the toner image on the surface of the photosensitive drum 21 to the recording paper. Then, the recording paper is conveyed through a point between a hot roller 28 and a pressure roller 29 of a fixing device 27 for the application of heat and pressure, and, thus, the toner image on the recording paper is fixed.

Meanwhile, the paper feed portion 13 is provided with a plurality of paper cassettes 38. The paper cassettes 38 are each provided with a pickup roller 39 and the like for drawing out and sending out recording papers sheet by sheet. The drawn out recording papers are sent out to the paper transport path 33 of the paper transport portion 12.

Furthermore, the large capacity cassette (LCC) 14 can accommodate a large amount of recording papers. The recording papers are drawn out sheet by sheet, and sent out to the paper transport path 33 of the paper transport portion 12.

The recording paper is transported through the paper transport path 33, travels via the transfer roller 25 and the fixing device 27, and is discharged via paper discharge rollers 36 to a paper discharge tray 37. On the paper transport path 33, registration rollers 32 that, after temporarily stopping the recording paper and aligning the leading edge of the recording paper, start the transport of the recording paper at a timing synchronized with the transfer timing of the toner image at the nip region between the photosensitive drum 21 and the transfer roller 25, transport roller pairs 31 that facilitate the transport of the recording paper, the paper discharge rollers 36, and the like are arranged.

Furthermore, when performing printing on the back face of the recording paper after doing so on the front face, the position of a branching gate 35 is switched, so that the recording paper is transported in the opposite direction from the paper discharge rollers 36 into a reverse path 34 where the front and the back of the recording paper are reversed, and the recording paper is guided again to the registration rollers 32. Subsequently, as in the case of the front face of the recording paper, an image is recorded on and fixed to the back face of the recording paper, and the recording paper is discharged to the paper discharge tray 37.

Next, the document reading device 2 that is mounted in the upper portion of the main body of the image forming apparatus 1 will be described. In the document reading device 2, the inner side of a document transport portion 42 is axially supported by a hinge (not shown) on the inner side of a first reading portion 41. When the document transport portion 42 is opened by lifting its outer side portion, a document can be placed on a glass platen 44 of the first reading portion 41.

In the first reading portion 41, while a first scanning unit 45 is moving in the sub-scanning direction, a surface of a document on the glass platen 44 is illuminated by a light source 51, and light reflected by that surface is further reflected by a first reflective mirror 52 and guided to a second scanning unit 46. While the second scanning unit 46 is moving following the first scanning unit 45, the reflected light from the document is reflected by second and third reflective mirrors 53 and 54. This reflected light is converged by an imaging lens 47 onto a charge coupled device (CCD) 48, and, thus, the image of the document is read by the CCD 48.

Furthermore, when reading an image on a front face of a document that is being transported by the document transport portion 42, as shown in FIG. 1, the first scanning unit 45 is moved to a reading position below a document reading glass 55, and the second scanning unit 46 is positioned according to the position of the first scanning unit 45. In this state, a document on a document tray 57 is drawn out by a pickup roller 56 and transported through a document transport path 58, the front face of the document is illuminated by the light source 51 of the first scanning unit 45 via the document reading glass 55, light reflected by the document is guided by the reflective mirrors of the first and the second scanning units 45 and 46 to the imaging lens 47, the image of the document is read by the CCD 48, and the document is discharged via document discharge rollers 61 to a document discharge tray 62.

Furthermore, a built-in second reading portion 43 (contact image sensor (CIS)) in the document transport portion 42 illuminates a back face of the document that is being passed below the second reading portion (CIS) 43 and is to be discharged to the document discharge tray 62, receives the reflected light from the back face of the document, and reads an image on the back face of the document.

The images of the document read by the CCD 48 and the CIS 43 in this manner are input to the laser exposure device 23 of the image forming apparatus 1, and are recorded by the image forming apparatus 1 on a recording paper, and this recording paper is output as a copied document.

Next, the configuration of built-in paper feed devices 71 in the large capacity cassette 14 of this embodiment will be described in detail. The paper feed devices 71 each contain a large amount of recording papers in a stacked manner, draw out the recording papers sheet by sheet, and send out the recording papers to the paper transport path 33 (shown in FIG. 1) of the image forming apparatus 1.

Figure 2:
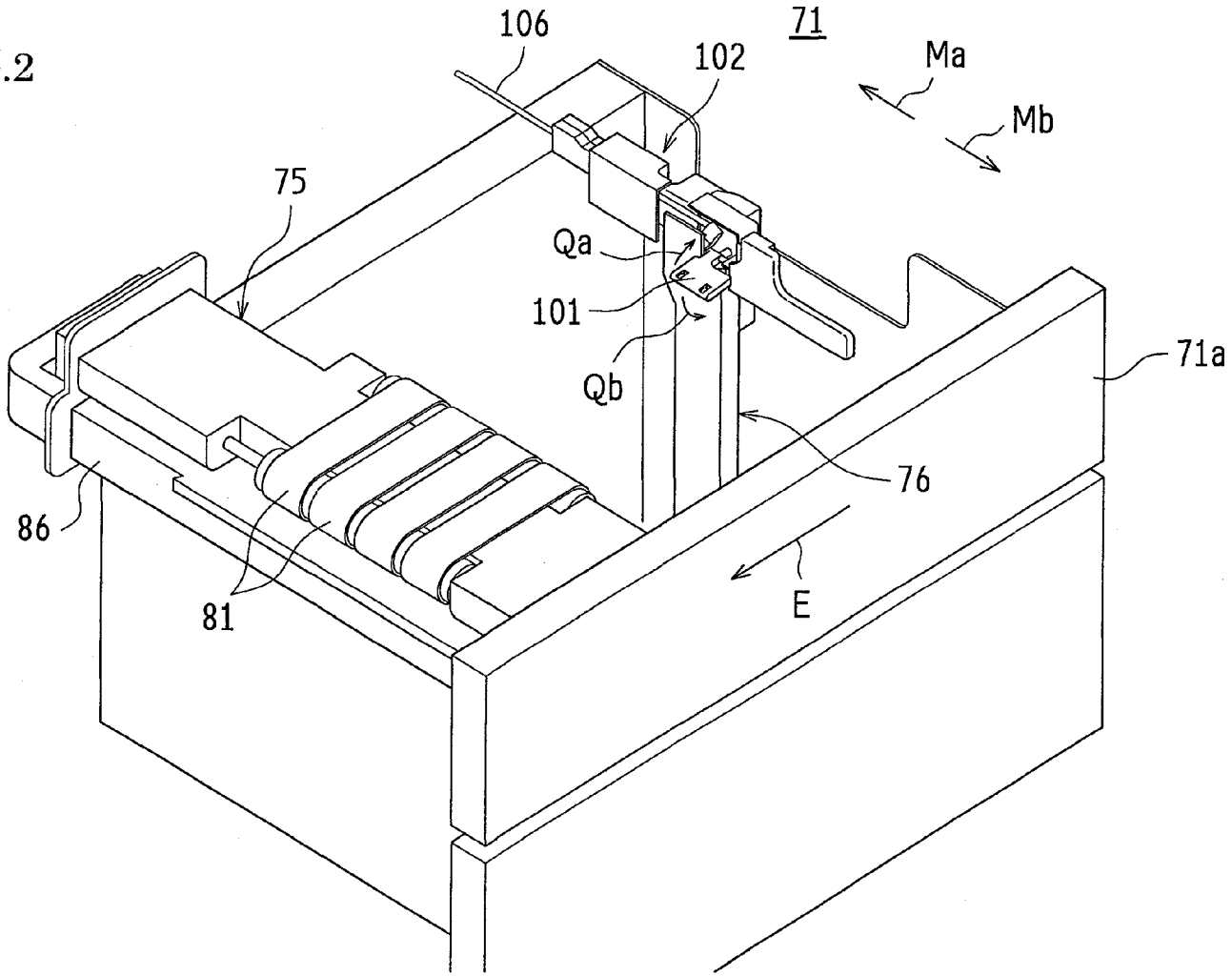
FIG. 2 is a perspective view showing the external appearance of the paper feed device of this embodiment viewed obliquely from an upper front side.

FIG. 2 is a perspective view showing the external appearance of the paper feed device 71 of this embodiment viewed obliquely from an upper front side. The paper feed device 71 has a drawer casing 71*a*, and the main portion of the paper feed device 71 is disposed inside the drawer casing 71*a*. The drawer casing 71*a* is supported such that it can reciprocally move in the arrow directions Ma and Mb inside the main body of the large capacity cassette 14, for example, by a well-known mechanism formed by combining rollers and rails (not shown). Thus, the paper feed device 71 can be pulled out from and pushed into an accommodation space inside the main body of the large capacity cassette 14. In the state in which the paper feed device 71 has been pulled out from the accommodation space inside the main body of the large capacity cassette 14, a paper bundle is supplied and set to the paper feed device 71. Furthermore, in the state in which the paper feed device 71 has been pushed into the accommodation space inside the main body of the large capacity cassette 14, paper in the paper bundle is sequentially drawn out by the paper feed device 71 and fed into the paper transport path 33 of the image forming apparatus 1.

Figure 3:
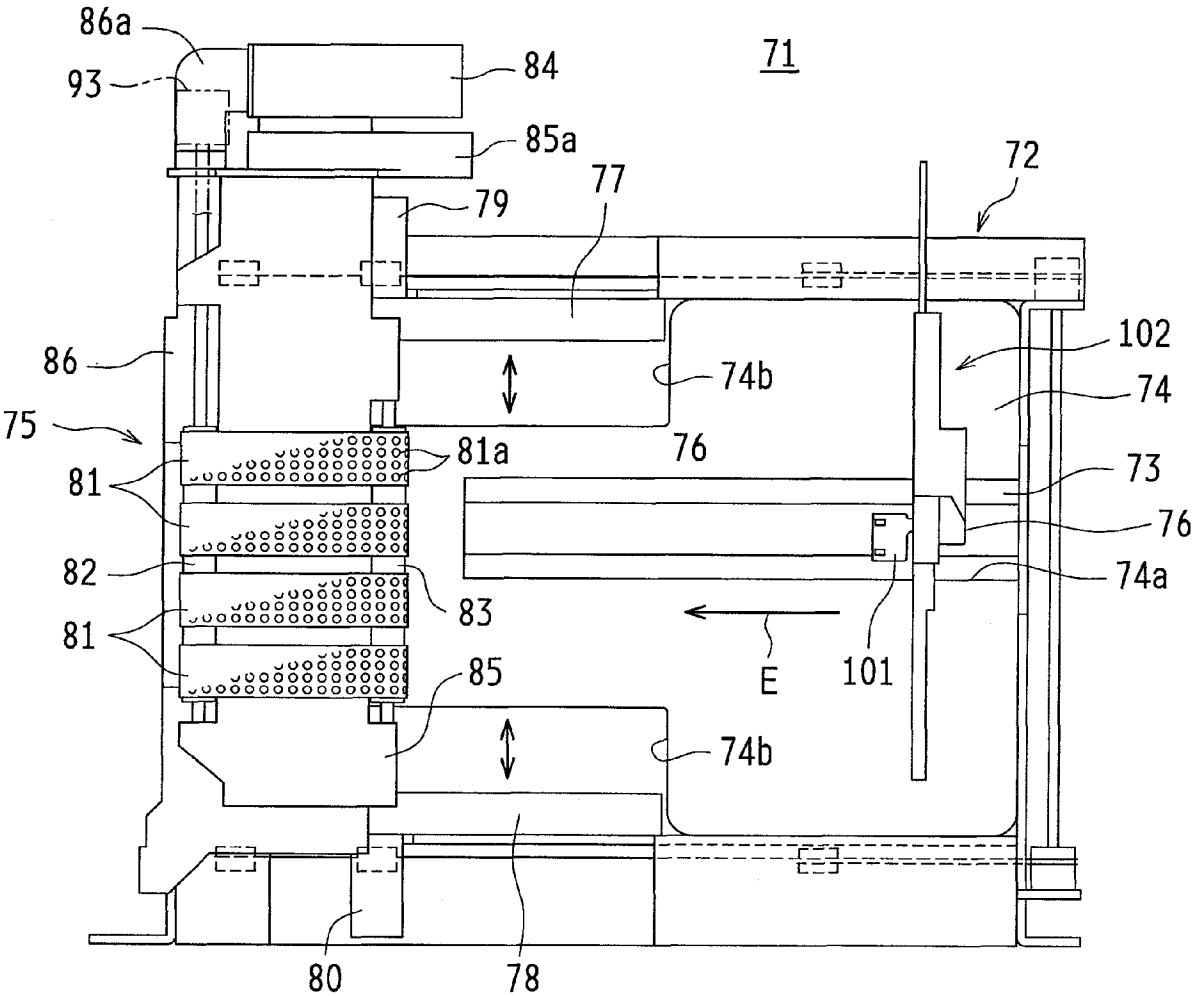
FIG. 3 is a plan view showing a main portion of the paper feed device.
Figure 4:
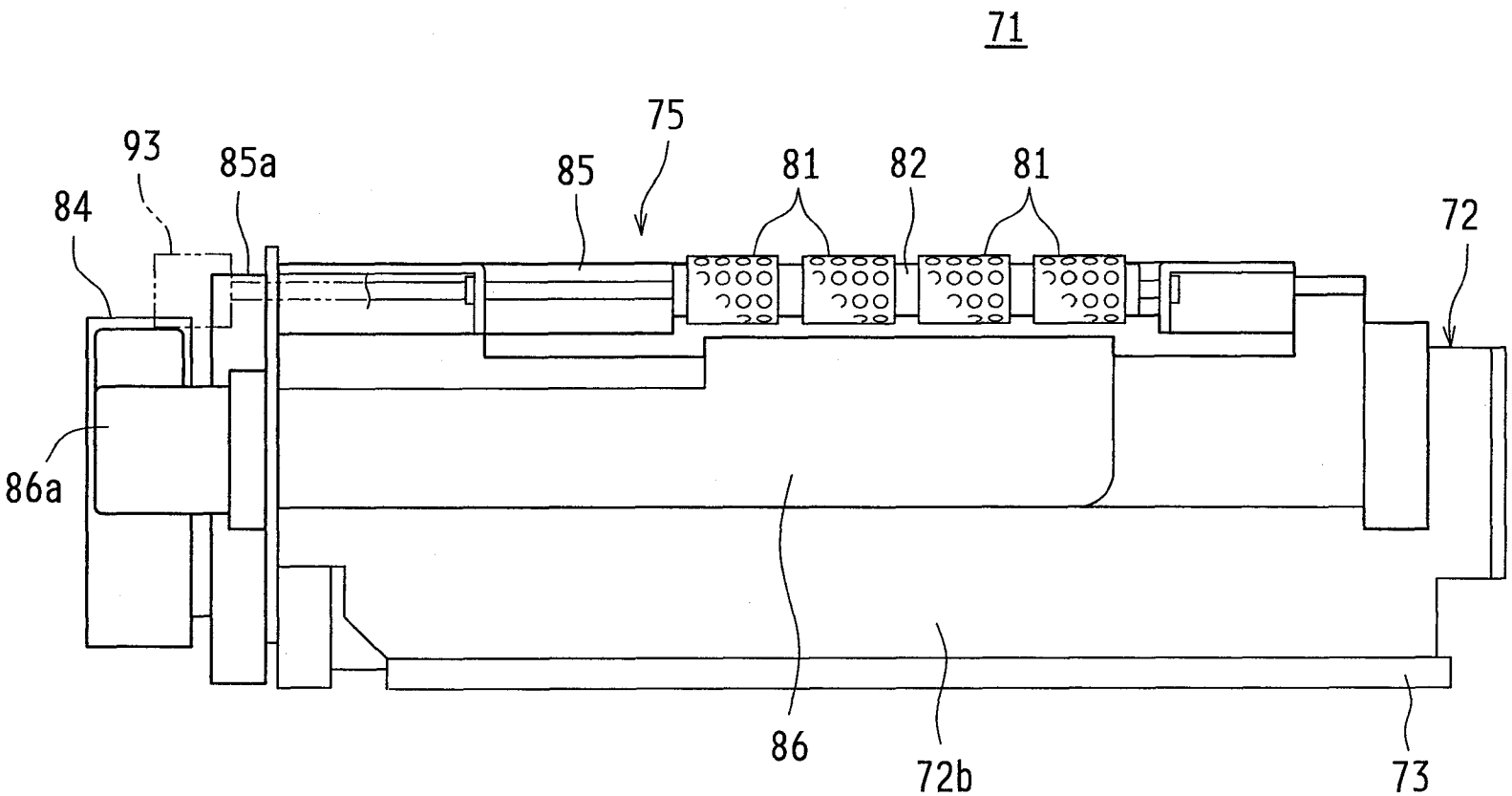
FIG. 4 is a front view showing a main portion of the paper feed device.

FIGS. 3 and 4 are a plan view and a front view showing the main portion of the paper feed device 71 inside the drawer casing 71*a*. As shown in FIGS. 3 and 4, the paper feed device 71 is provided with a main frame 72, a bottom plate 73, a paper stacking shelf 74 that is disposed inside the main frame 72, a paper drawing-out portion 75 that is disposed at an upper portion of one edge of the main frame 72, and the like.

The paper stacking shelf 74 allows a large amount of recording papers (paper bundle) to be stacked thereon, and is disposed such that it can vertically move inside the main frame 72. Recesses 74*b* are formed respectively on both sides on the paper stacking shelf 74, and assist ducts 77 and 78 are arranged in the respective recesses 74*b*. The assist ducts 77 and 78 are supported on both sides of the main frame 72 such that they can reciprocally move in directions orthogonal to a drawing-out direction E, and are moved in conjunction with each other so as to be closer to or away from each other.

Furthermore, an opening portion 74*a* that is long in the recording paper drawing-out direction (paper transport direction) E is formed at the center of the paper stacking shelf 74. A paper trailing edge guide 76 is supported such that it can reciprocally move in directions along the recording paper drawing-out direction E on the bottom plate 73, and is projected upward through the opening portion 74*a* of the paper stacking shelf 74. Note that a side in the recording paper drawing-out direction (paper transport direction) E is taken as a front side, and a side in the direction opposite to the drawing-out direction E is taken as a rear side.

The paper drawing-out portion 75 is provided with four endless paper transport belts 81, a pair of rollers 82 and 83 between which the paper transport belts 81 are stretched, an intake and exhaust fan 84, an intake duct 85, and an exhaust duct 86, and the like. A large number of air through holes 81*a* are formed through the paper transport belts 81, and air is sucked from the air through holes 81*a* of the paper transport belts 81 via the intake duct 85 to the intake and exhaust fan 84. Furthermore, air exhausted from the intake and exhaust fan 84 is guided through the exhaust duct 86, and blown in the direction opposite to the drawing-out direction E (to the rear side) from the exhaust duct 86 to the inside of the main frame 72.

Figure 5:
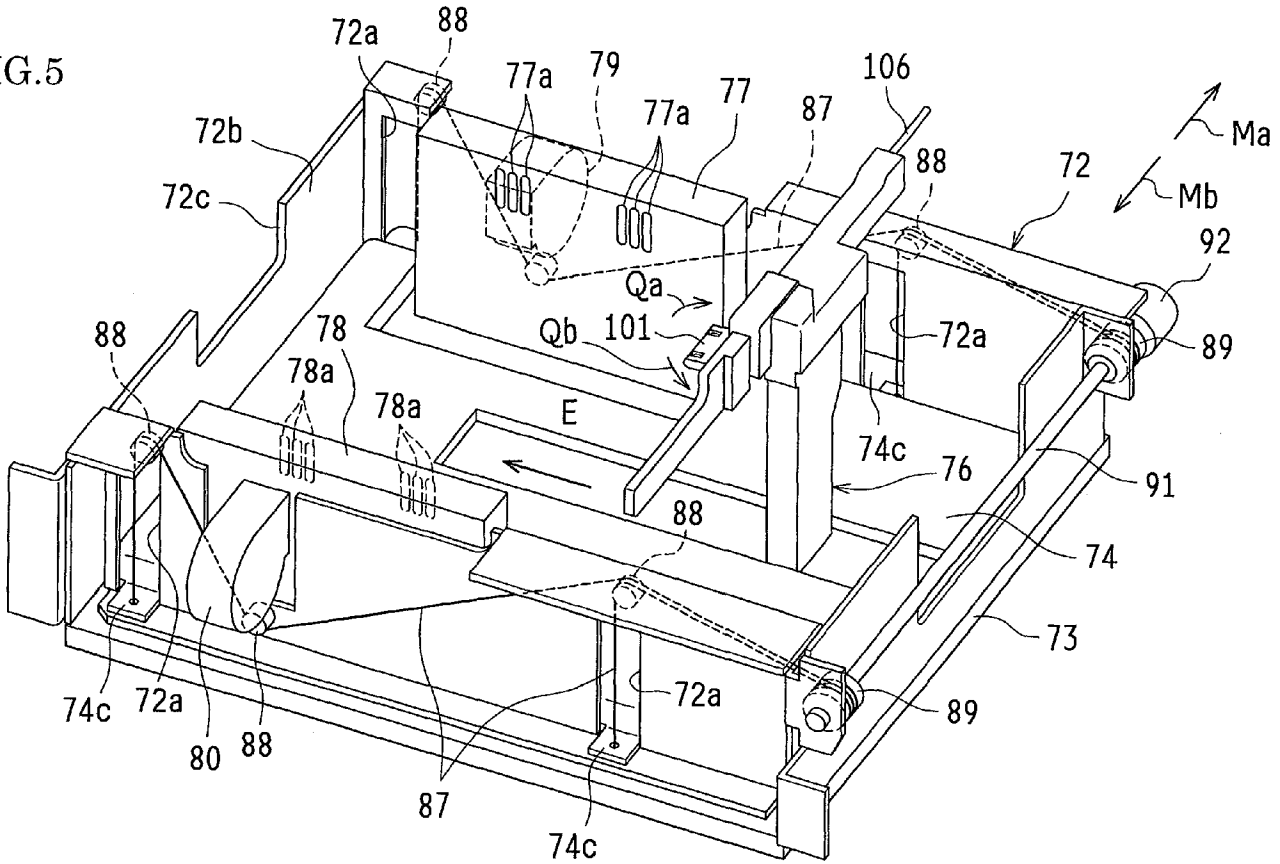
FIG. 5 is a perspective view showing the paper feed device in a state in which a paper drawing-out portion has been removed, viewed obliquely from an upper rear side.

FIG. 5 is a perspective view showing the main frame 72, the bottom plate 73, the paper stacking shelf 74, and the like viewed obliquely from an upper rear side in a state in which the paper drawing-out portion 75 has been removed. As shown in FIG. 5, assist fans 79 and 80 are respectively arranged on the outer sides of the assist ducts 77 and 78. The assist ducts 77 and 78 are hollow members internally including air through paths, so that air sucked by the assist fans 79 and 80 is sent to the air through paths in the assist ducts 77 and 78, and is then blown from exhaust openings 77*a* and 78*a* of the assist ducts 77 and 78 into the inside of the main frame 72.

Furthermore, as shown in FIGS. 3 and 5, the assist ducts 77 and 78 can reciprocally move in directions orthogonal to the drawing-out direction E, and can be positioned at any position in directions orthogonal to the drawing-out direction E.

At the upper end of the paper trailing edge guide 76, a contact member 101 is supported such that it can be reciprocally rotated in arrow rotational directions Qa and Qb. The contact member 101 is reciprocally rotated by a position switch portion 102. When the paper feed device 71 is pulled out from the accommodation space inside the main body of the large capacity cassette 14, the position switch portion 102 causes, in conjunction with the operation that pulls out the paper feed device 71, the contact member 101 to be rotated and withdrawn in the arrow rotational direction Qa substantially to the vertical direction. In this state, a paper bundle can be supplied and set on the paper stacking shelf 74 without being caught on the contact member 101. On the other hand, when the paper feed device 71 is pushed into the accommodation space inside the main body of the large capacity cassette 14, the position switch portion 102 causes, in conjunction with the operation that pushes in the paper feed device 71, the contact member 101 to be rotated downward in the arrow rotational direction Qb substantially to the horizontal direction. In this state, when the paper stacking shelf 74 is lifted and the contact member 101 is brought into contact with the trailing edge portion of the upper face of the paper bundle, the contact member 101 prevents the trailing edge portion of the recording papers in the paper bundle from moving upward. The contact member 101 and the position switch portion 102 will be described later in detail.

Furthermore, as shown in FIGS. 3 and 5, the paper trailing edge guide 76 can reciprocally move in directions along the recording paper drawing-out direction E, and can be positioned at any position in the drawing-out direction E.

As shown in FIG. 5, two projection pieces 74*c* are formed each on both sides on the paper stacking shelf 74, and the projection pieces 74*c* are projected from opening portions 72*a* on both sides of the main frame 72. On one side of the main frame 72, two wires 87 are connected to the projection pieces 74*c* on that side of the paper stacking shelf 74, and the wires 87 are caught on and drawn around a plurality of driven pulleys 88 and connected to a take-up pulley 89. Furthermore, also on the other side of the main frame 72, another two wires 87 are connected to the projection pieces 74*c* on that side of the paper stacking shelf 74, and the wires 87 are caught on and drawn around another plurality of driven pulleys 88 and connected to another take-up pulley 89. The take-up pulleys 89 are fixed to both ends of a common shaft 91 that is supported in a rotatable manner. When the shaft 91 is rotationally driven by a pulse motor 92, the take-up pulleys 89 are rotated, so that the wires 87 are taken up by the take-up pulleys 89 or released from the take-up pulleys 89.

When the shaft 91 is rotationally driven by the pulse motor 92 and the take-up pulleys 89 are rotated clockwise, the wires 87 are taken up by the take-up pulleys 89, and the paper stacking shelf 74 is lifted. On the other hand, when the take-up pulleys 89 are rotated counterclockwise, the wires 87 are released from the take-up pulleys 89, and the paper stacking shelf 74 is lowered. Furthermore, the rotational angle of the take-up pulleys 89 rotationally driven by the pulse motor 92 and the height of the paper stacking shelf 74 correspond to each other. Accordingly, the height of the paper stacking shelf 74 can be adjusted and set by controlling the rotational direction and the rotational angle of the pulse motor 92.

Figure 6:
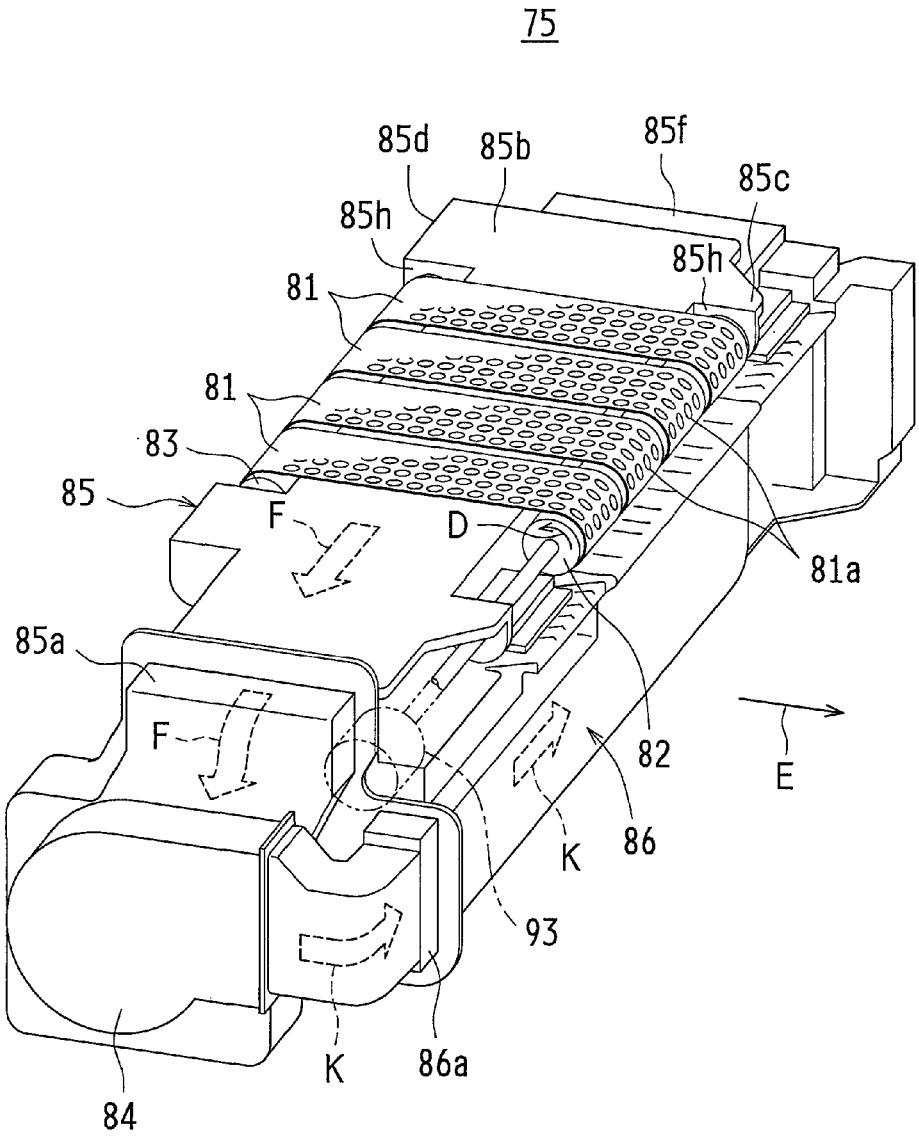
FIG. 6 is a perspective view showing the paper drawing-out portion of the paper feed device viewed obliquely from an upper front side.

Next, the configuration of the paper drawing-out portion 75 will be described in detail. FIG. 6 is a perspective view showing the paper drawing-out portion 75 viewed obliquely from an upper front side. Furthermore, FIG. 7 is a perspective view showing the paper drawing-out portion 75 viewed obliquely from an upper rear side, and FIG. 8 is a perspective view showing the paper drawing-out portion 75 viewed obliquely from a lower rear side.

Figure 7:
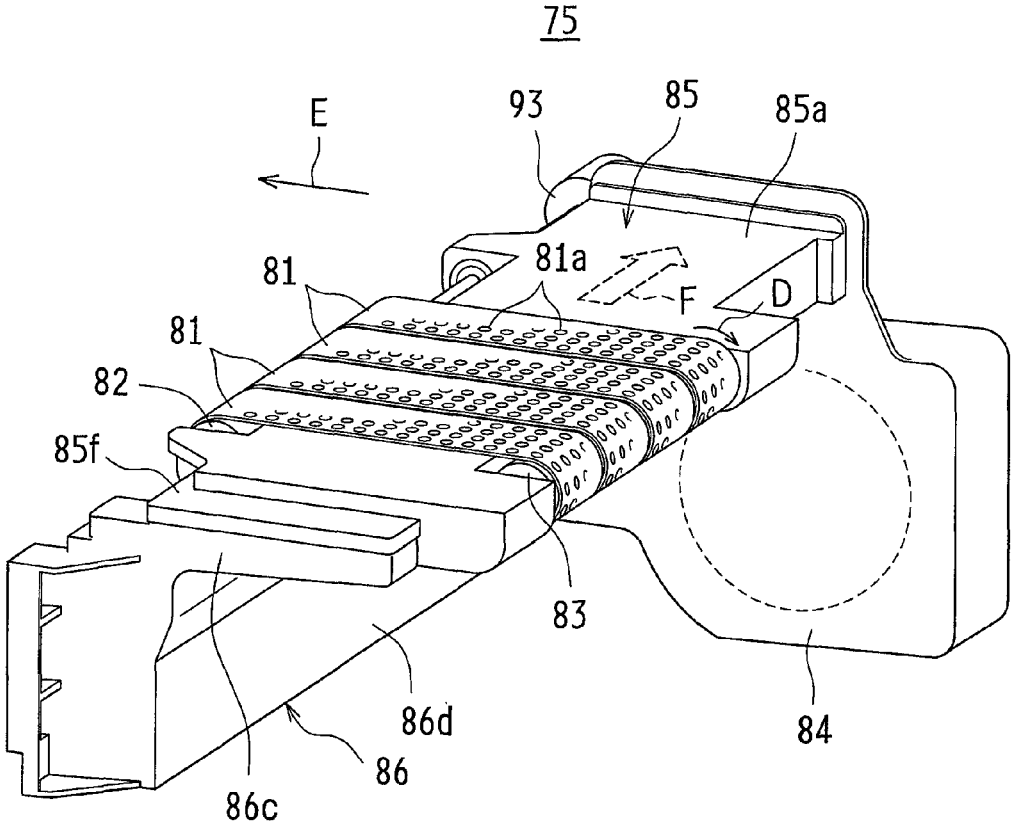
FIG. 7 is a perspective view showing the paper drawing-out portion viewed obliquely from an upper rear side.
Figure 8:
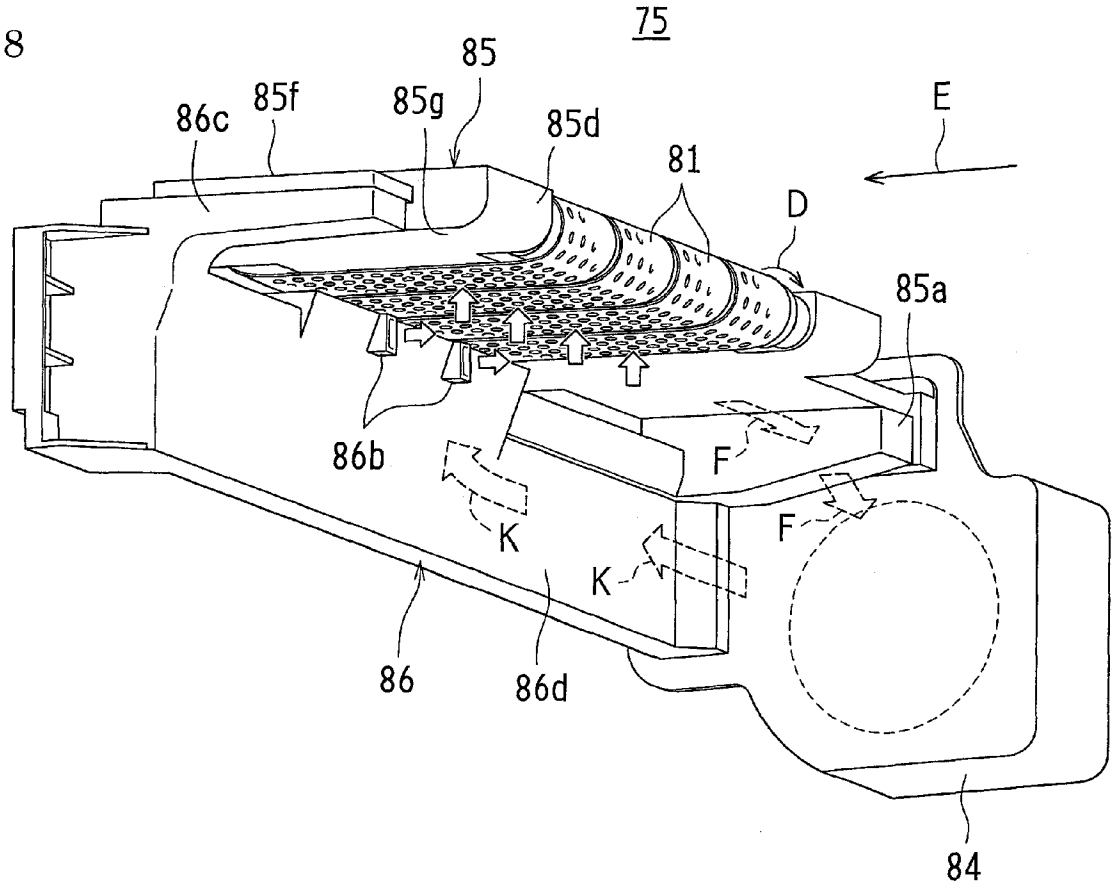
FIG. 8 is a perspective view showing the paper drawing-out portion viewed obliquely from a lower rear side.

As shown in FIGS. 6, 7, and 8, the paper drawing-out portion 75 is provided with the four endless paper transport belts 81, the pair of rollers 82 and 83 between which the paper transport belts 81 are stretched, the intake and exhaust fan 84, the intake duct 85, the exhaust duct 86, and the like.

The intake duct 85 is a hollow member internally including an air intake path that is long in a direction orthogonal to the drawing-out direction (paper transport direction) E, and one end portion 85*a* thereof is connected to the intake and exhaust fan 84. Thus, as indicated by the arrow F, air is sucked from the air intake path in the intake duct 85 via the end portion 85*a* to an air intake opening (not shown) of the intake and exhaust fan 84.

Furthermore, a lower face 85*g* of the intake duct 85 is provided with air intake holes 94 (shown in FIG. 9) that overlap the plurality of air through holes 81*a* of the paper transport belts 81, corresponding to each paper transport belt 81. The air intake holes 94 are in connection with the air intake path in the intake duct 85. When air inside the intake duct 85 is sucked by the intake and exhaust fan 84, external air flows into the air intake holes 94 on the lower face 85*g* of the intake duct 85 and the air through holes 81*a* of the paper transport belts 81.

Furthermore, a front end portion 85*c* and a rear end portion 85*d* of the intake duct 85 are respectively provided with recesses 85*h*. The rollers 82 and 83 are respectively arranged in the recesses 85*h* and axially supported in a rotatable manner, and the shaft of the roller 82 on the front side is connected to the output shaft of a transport motor 93. The paper transport belts 81 are stretched between the rollers 82 and 83. The roller 82 on the front side is rotationally driven in the arrow direction D by the transport motor 93, the roller 83 on the rear side is idly rotated, and, thus, the paper transport belts 81 circumferentially move in the arrow direction D.

Furthermore, the exhaust duct 86 is also a hollow member including an air through path that is long in a direction orthogonal to the drawing-out direction E, and one end portion 86*a* thereof is connected to the intake and exhaust fan 84. Thus, as indicated by the arrow K, air is sent from an air exhaust opening (not shown) of the intake and exhaust fan 84 via the end portion 86*a* of the exhaust duct 86 into the air through path in the exhaust duct 86.

An inner wall face 86*d* of the exhaust duct 86 is provided with exhaust openings 86*b* that are in connection with the air through path in the exhaust duct 86. The inner wall face 86*d* of the exhaust duct 86 is disposed so as to be overlaid on an outer face of a rectangular plate 72*b* (shown in FIG. 5) of the main frame 72, and the exhaust openings 86*b* of the exhaust duct 86 face the inside of the main frame 72 via a cut-out portion 72*c* of the rectangular plate 72*b* of the main frame 72. When air is sent from the intake and exhaust fan 84 into the exhaust duct 86, this air is blown from the exhaust openings 86*b* rearward to the inside of the main frame 72.

Furthermore, the end portion 85*a* of the intake duct 85 and the end portion 86*a* of the exhaust duct 86 are both connected to the intake and exhaust fan 84, and another end portion 85*f* of the intake duct 85 and another end portion 86*c* of the exhaust duct 86 are connected to each other, and, thus, the intake and exhaust fan 84, the intake duct 85, and the exhaust duct 86 are integrated.

In this sort of paper feed device 71, when the paper feed device 71 is pulled out from the accommodation space inside the main body of the large capacity cassette 14, the position switch portion 102 causes, in conjunction with the operation that pulls out the paper feed device 71, the contact member 101 to be rotated and withdrawn in the arrow rotational direction Qa substantially to the vertical direction, as described above.

In this state, the paper trailing edge guide 76 is moved to the rear side, and, thus, the distance between the paper trailing edge guide 76 and the rectangular plate 72*b* of the main frame 72 is increased. Moreover, the assist ducts 77 and 78 are moved so as to be away from each other, and, thus, the distance between the assist ducts 77 and 78 is increased. At that time, since the contact member 101 has been withdrawn substantially to the vertical direction, a paper bundle can be supplied and set on the paper stacking shelf 74 without being caught on the contact member 101. Subsequently, the paper trailing edge guide 76 is moved in the drawing-out direction E, so that the trailing edge of the paper bundle is pushed in the drawing-out direction E by the paper trailing edge guide 76, the paper bundle is slid on the paper stacking shelf 74, the leading edge of the paper bundle is brought into contact with the rectangular plate 72*b* of the main frame 72, and, thus, the leading edge and the trailing edge of the paper bundle are held and positioned between the paper trailing edge guide 76 and the rectangular plate 72*b* of the main frame 72. Moreover, the assist ducts 77 and 78 are moved so as to be closer to each other, and, thus, both sides of the paper bundle are held and positioned between the assist ducts 77 and 78.

Subsequently, when the paper feed device 71 is pushed into the accommodation space inside the main body of the large capacity cassette 14, the position switch portion 102 causes, in conjunction with the operation that pushes in the paper feed device 71, the contact member 101 to be rotated downward in the arrow rotational direction Qb substantially to the horizontal direction, as described above. In this state, the take-up pulleys 89 are rotated clockwise by the pulse motor 92, and the paper stacking shelf 74 is lifted, until the uppermost sheet of recording paper in the paper bundle is brought into contact with the contact member 101. Thus, the trailing edge portion of the upper face of the paper bundle is pressed by the contact member 101, and the trailing edge portion of the recording papers in the paper bundle is prevented from moving upward.

Figure 9:
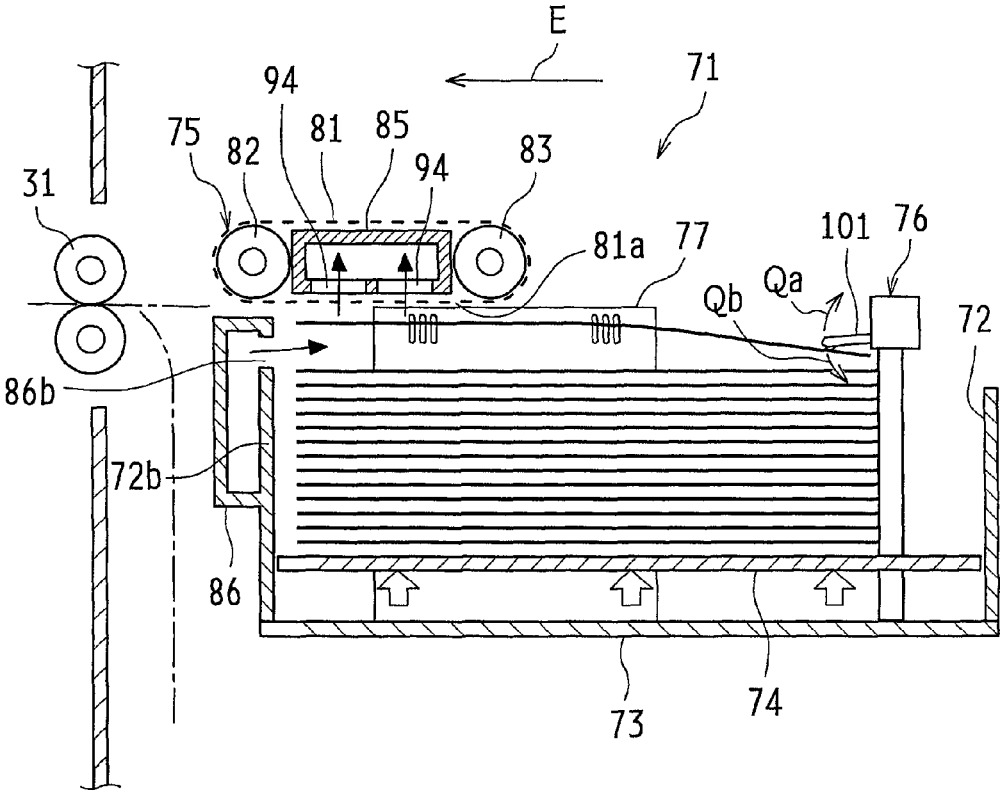
FIG. 9 is a cross-sectional view schematically showing the paper feed device.

In the state in which the trailing edge portion of the upper face of the paper bundle is pressed by the contact member 101 in this manner, as shown in the schematic cross-sectional view in FIG. 9, air is sent from the assist fans 79 and 80 into the assist ducts 77 and 78, this air is blown from the exhaust openings 77*a* and 78*a* of the assist ducts 77 and 78 against the upper layer of both side end faces of the paper bundle on the paper stacking shelf 74 so as to enter between the recording papers, and, thus, the recording papers are separated. Furthermore, air is sent from the intake and exhaust fan 84 into the exhaust duct 86, so that this air is blown from the exhaust openings 86*b* of the exhaust duct 86 against the upper layer of a front end face of the paper bundle so as to enter between the recording papers, and, thus, the recording papers are separated. Accordingly, the adhesive force between the recording papers in the upper layer of the paper bundle is lowered, so that recording papers can be easily drawn out from the paper bundle, and recording papers can be easily drawn out sheet by sheet.

Then, air is sucked from the intake duct 85 into the intake and exhaust fan 84, so that air is sucked via the air through holes 81*a* of the paper transport belts 81 and the air intake holes 94 on the lower face 85*g* of the intake duct 85, and an uppermost sheet of recording paper is caused to adhere to the surfaces of the paper transport belts 81. At that time, since the uppermost sheet of recording paper in the paper bundle has been positioned at a contact position at which that sheet is in contact with the contact member 101, the uppermost sheet of recording paper can be caused to quickly adhere to the surfaces of the paper transport belts 81. That is to say, the contact position is an optimum position for causing an uppermost sheet of recording paper to adhere to the surfaces of the paper transport belts 81.

Furthermore, the rollers 82 and 83 are simultaneously rotated by the transport motor 93, so that the paper transport belts 81 circumferentially move. Thus, the uppermost sheet of recording paper is drawn out in the drawing-out direction E by the paper transport belts 81, and the recording paper is transported via the transport roller pair 31 of the image forming apparatus 1 to the paper transport path 33.

Furthermore, after the recording paper has been transported to the transport roller pair 31, the suction of air by the intake and exhaust fan 84 and the rotation of the rollers 82 and 83 by the transport motor 93 are temporarily stopped. Then, when the recording paper is completely drawn out from the paper transport belts 81, the suction of air by the intake and exhaust fan 84 and the rotation of the rollers 82 and 83 by the transport motor 93 are resumed, so that a next uppermost sheet of recording paper is caused to adhere to the surfaces of the paper transport belts 81, and the recording paper is drawn out in the drawing-out direction E by the paper transport belts 81 and transported to the transport roller pair 31. Subsequently, in a similar manner, uppermost sheets of recording paper are repeatedly caused to adhere to the surfaces of the paper transport belts 81, and the recording papers are drawn out in the drawing-out direction E by the paper transport belts 81 and transported.

In this manner, in the paper feed device 71, when supplying recording papers to the paper stacking shelf 74, the contact member 101 is rotated and withdrawn in the arrow rotational direction Qa substantially to the vertical direction in conjunction with the operation that pulls out the paper feed device 71, and, thus, the paper bundle can be immediately supplied to the paper stacking shelf 74 without being caught on the contact member 101. Furthermore, the contact member 101 is rotated downward in the arrow rotational direction Qb substantially to the horizontal direction in conjunction with the operation that pushes in the paper feed device 71, and, thus, the contact member 101 can be brought into contact with the trailing edge portion of the upper face of the paper bundle, so that the contact member 101 can prevent the trailing edge portion of the recording papers in the paper bundle from moving upward.

Accordingly, the contact member 101 can be moved away and withdrawn from, or brought into contact with the upper face of a paper bundle, only with the operation that pulls out or pushes in the paper feed device 71, and, thus, a paper bundle can be supplied in a short period of time.

Furthermore, air from the exhaust openings 77*a* and 78*a* of the assist ducts 77 and 78 and air from the exhaust openings 86*b* of the exhaust duct 86 are blown against end faces of the paper bundle on the paper stacking shelf 74 so that the recording papers are separated, and, in this state, the uppermost sheet of recording paper in the paper bundle is transported while being caused to adhere to the surfaces of the paper transport belts 81. Accordingly, a large amount of recording papers can be drawn out and transported at high speed.

Figure 10:
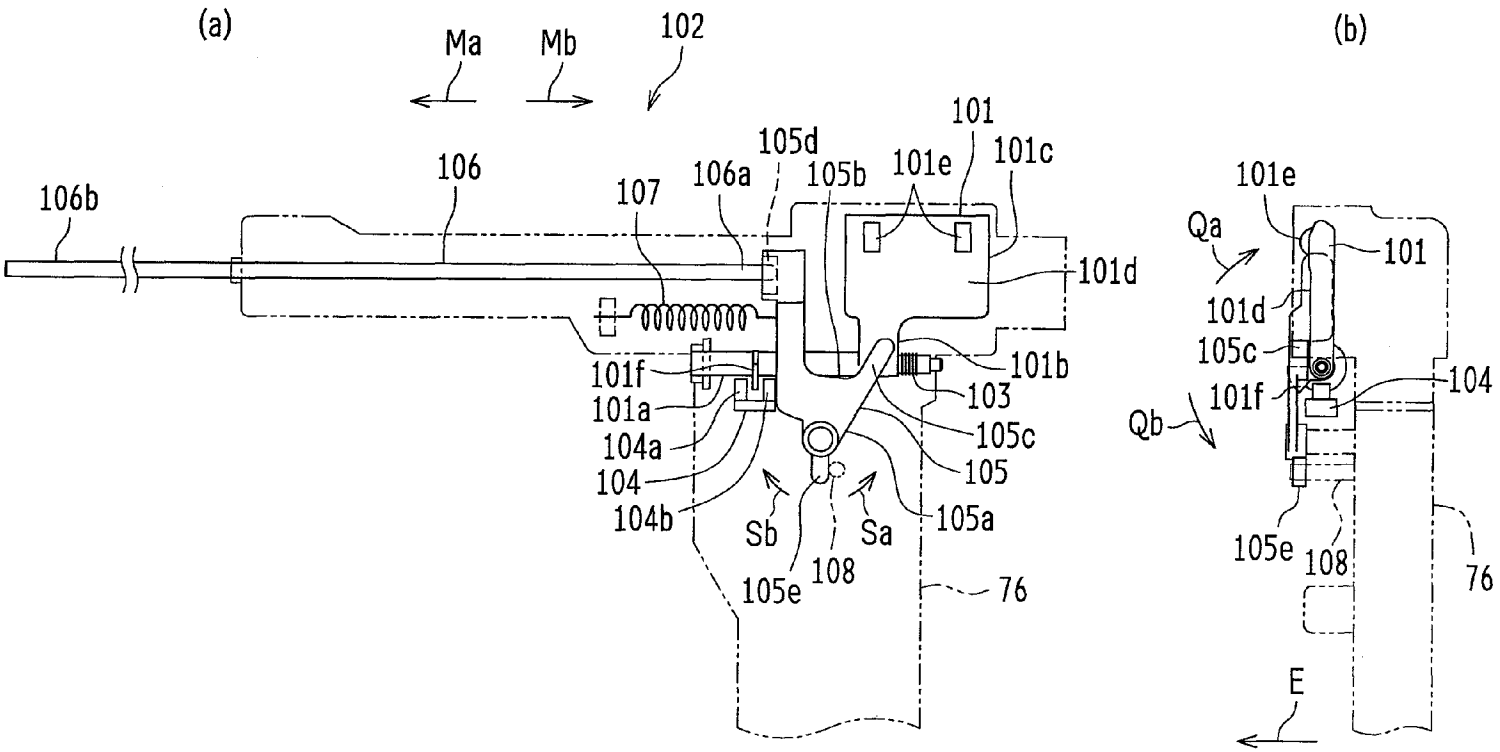
FIGS. 10 (*a*) and 10 (*b*) are a front view and a side view showing a contact member and a position switch portion respectively viewed from a front side and a lateral side, in a state in which the paper feed device is pulled out.
Figure 11:
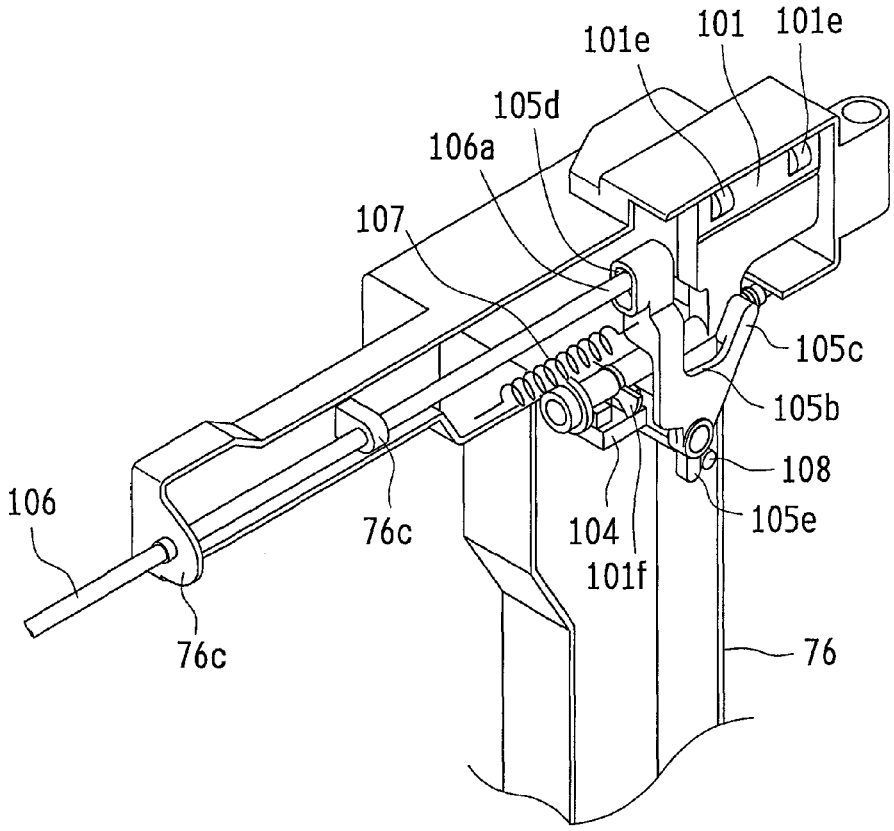
FIG. 11 is a perspective view showing the contact member and the position switch portion viewed obliquely from an upper front side, in a state in which the paper feed device is pulled out.
Figure 12:
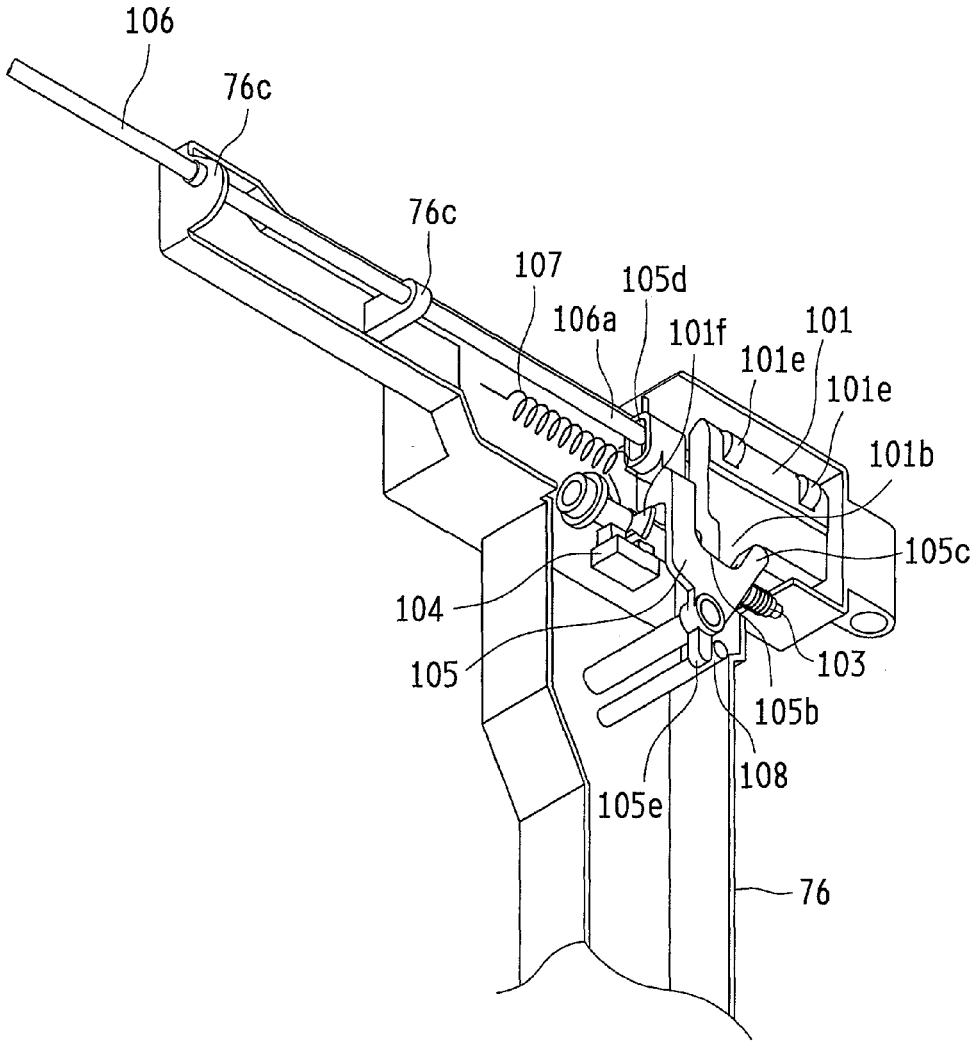
FIG. 12 is a perspective view showing the contact member and the position switch portion viewed obliquely from a lower front side, in a state in which the paper feed device is pulled out.
Figure 14:
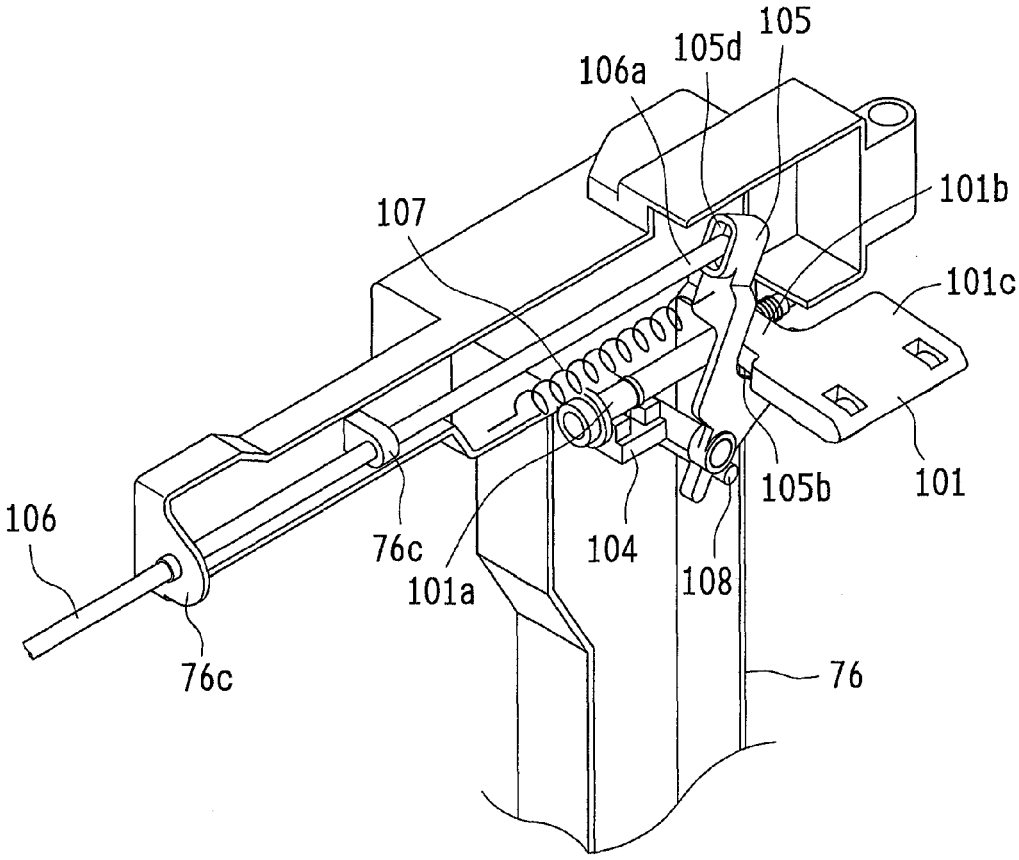
Figure 15:
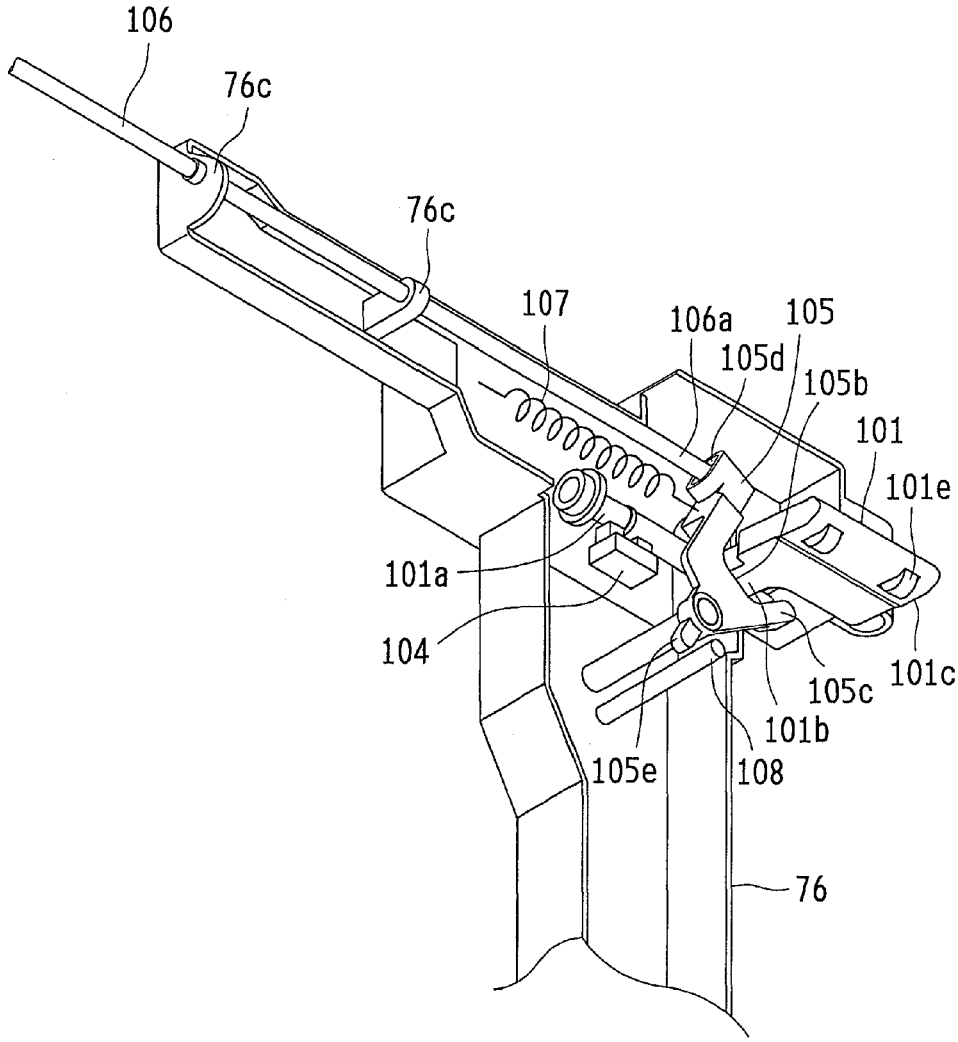

Next, the configurations of the contact member 101 and the position switch portion 102 will be described in detail. FIGS. 10 (*a*), 10 (*b*), 13 (*a*), and 13 (*b*) are front views and side views showing the contact member 101 and the position switch portion 102 arranged on the upper end of the paper trailing edge guide 76, viewed from a front side and a lateral side. Furthermore, FIGS. 11 and 14 are perspective views showing the contact member 101 and the position switch portion 102 viewed obliquely from an upper front side. Furthermore, FIGS. 12 and 15 are perspective views showing the contact member 101 and the position switch portion 102 viewed obliquely from a lower front side.

Furthermore, FIGS. 10 (*a*), 10 (*b*), 11, and 12 show the state of the contact member 101 and the position switch portion 102 when the paper feed device 71 is pulled out. Furthermore, FIGS. 13 (*a*), 13 (*b*), 14, and 15 show the state of the contact member 101 and the position switch portion 102 when the paper feed device 71 is pushed in.

As shown in FIGS. 10 to 15, the contact member 101 is disposed at the upper end of the front face of the paper trailing edge guide 76 that is oriented in the recording paper drawing-out direction E. The contact member 101 has a shaft portion 101*a*, a column portion 101*b*, a rectangular plate 101*c*, two rollers 101*e*, and a fan-like blocking piece 101*f* that is fixed around the shaft portion 101*a*. Both ends of the shaft portion 101*a* are supported in a rotatable manner on two bearing portions (not shown) that are arranged on the front wall of the paper trailing edge guide 76. A torsion spring 103 is fitted to an end of the shaft portion 101*a*. One end of the torsion spring 103 is secured to the front wall of the paper trailing edge guide 76, and the other end of the torsion spring 103 is secured to the shaft portion 101*a*, and, thus, the shaft portion 101*a*, that is, the contact member 101 is biased in the arrow rotational direction Qb by the torsion spring 103.

The rectangular plate 101*c* of the contact member 101 is provided with two opening portions in which the rollers 101*e* are respectively arranged and axially supported in a rotatable manner, and the circumferential faces of the rollers 101*e* are projected from a lower face 101*d* of the rectangular plate 101*c*. The rollers 101*e* are spaced apart from each other in a direction orthogonal to the drawing-out direction E.

Furthermore, an optical sensor 104 is disposed below the shaft portion 101*a*, and is fixed to the front wall of the paper trailing edge guide 76. The optical sensor 104 is configured by a light-emitting element 104*a* and a light-receiving element 104*b* that oppose each other with a space interposed therebetween, and detects the blocking piece 101*f* when the blocking piece 101*f* rotating together with the contact member 101 is positioned between the light-emitting element 104*a* and the light-receiving element 104*b*.

Meanwhile, the position switch portion 102 is configured by the torsion spring 103, a rotatable member 105, a rod 106, a coil spring 107, and the like, and causes the contact member 101 to be moved away and withdrawn from, or to be brought into contact with the upper face of the paper bundle, in conjunction with the operation that pulls out or pushes in the paper feed device 71.

The rotatable member 105 is substantially in the shape of a V, and a top portion 105*a* of the V shape is supported in a rotatable manner on the front wall of the paper trailing edge guide 76, and, thus, the rotatable member 105 can be reciprocally rotated in the arrow rotational directions Sa and Sb. Furthermore, the inner portion of the V shape of the rotatable member 105 is formed as a curved portion 105*b*, one end of the V shape is an arm portion 105*c*, and the other end of the V shape has an elongated recess portion 105*d* that is long in the longitudinal direction and is oriented in the direction (the arrow direction Ma) in which the paper feed device 71 is pushed for accommodation.

Both ends of the coil spring 107 are respectively secured to the front wall of the paper trailing edge guide 76 and to the rotatable member 105 at a point near the elongated recess portion 105*d*, and, thus, the rotatable member 105 is biased and rotated in the arrow rotational direction Sa by the coil spring 107. Thus, a protrusion portion 105*e* of the rotatable member 105 is brought into contact with a stopper 108 formed on the front wall of the paper trailing edge guide 76, so that the rotational position of the rotatable member 105 is positioned.

The rod 106 is a member in the shape of a linear rod, and is supported such that it can reciprocally move in the arrow directions Ma and Mb (that match directions in which the paper feed device 71 is pulled out and pushed in) on two bearing portions 76*c* formed on the front wall of the paper trailing edge guide 76, and one end 106*a* of the rod 106 is fitted to and in contact with the elongated recess portion 105*d* of the rotatable member 105.

As shown in FIGS. 10 (*a*), 10 (*b*), 11, and 12, in the state in which the paper feed device 71 is pulled out, the rotatable member 105 is biased and rotated in the arrow rotational direction Sa by the coil spring 107, the protrusion portion 105*e* of the rotatable member 105 is brought into contact with the stopper 108 formed on the front wall of the paper trailing edge guide 76, so that the rotational position of the rotatable member 105 is positioned.

At that time, although the contact member 101 is biased in the arrow rotational direction Qb by the torsion spring 103, the rotation of the contact member 101 in the arrow rotational direction Qb is hampered because the arm portion 105*c* of the rotatable member 105 has been brought into contact with the column portion 101*b* of the contact member 101. Thus, the rectangular plate 101*c* of the contact member 101 is oriented upward substantially to the vertical direction so as to be withdrawn. Furthermore, the blocking piece 101*f* on the shaft portion 101*a* is projected in the drawing-out direction (the front side) E, and is moved away from the optical sensor 104.

Furthermore, since the rotatable member 105 is biased and rotated in the arrow rotational direction Sa by the coil spring 107, the end 106*a* of the rod 106 is pushed by the elongated recess portion 105*d* of the rotatable member 105 in the arrow direction Ma, and the rod 106 is moved in the arrow direction Ma.

Figure 13:
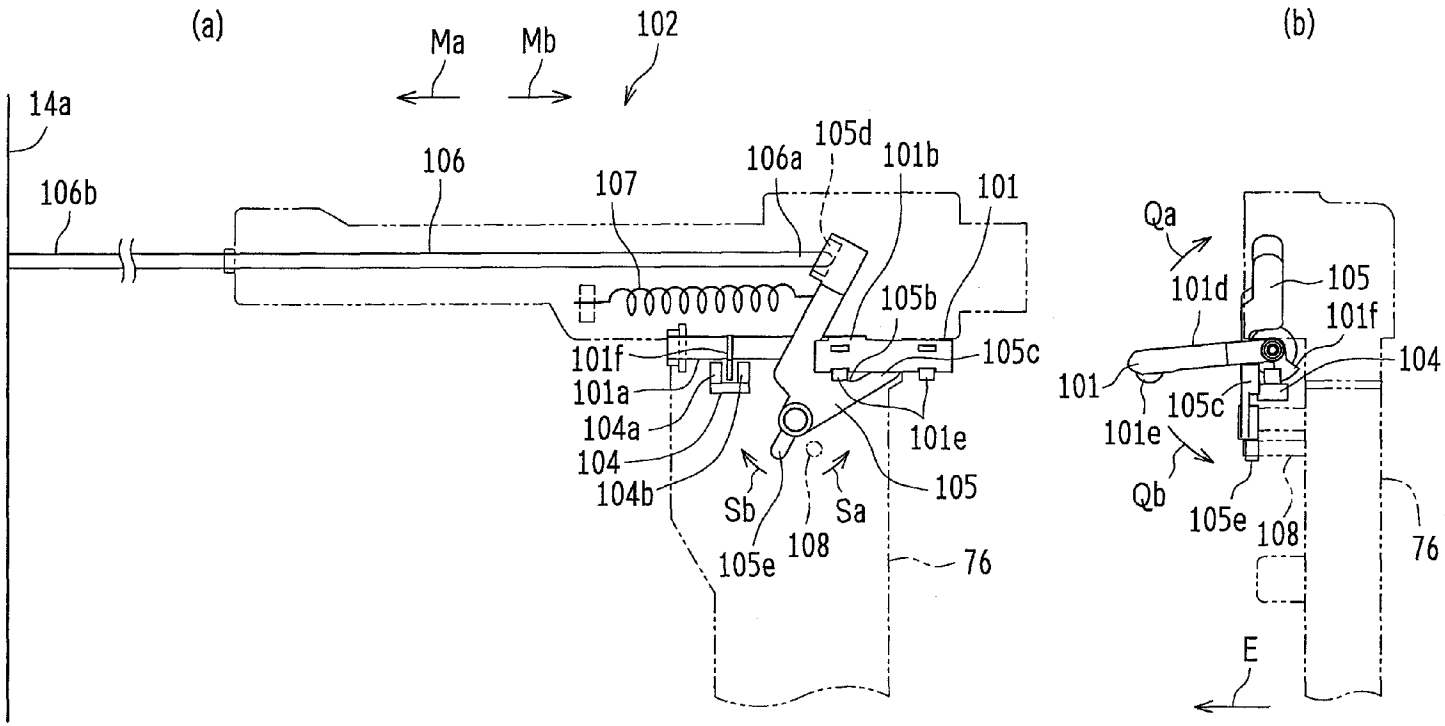

On the other hand, as shown in FIGS. 13 (*a*), 13 (*b*), 14, and 15, in the state in which the paper feed device 71 is pushed in, the entire paper feed device 71 is accommodated in the accommodation space inside the main body of the large capacity cassette 14, the other end 106*b* of the rod 106 is brought into contact with a main body frame 14*a* of the large capacity cassette 14, the rod 106 is moved in the arrow direction Mb, and the rotatable member 105 is rotated in the arrow rotational direction Sb resisting the biasing force of the coil spring 107.

Then, the arm portion 105*c* of the rotatable member 105 is moved away from the position of the column portion 101*b* of the contact member 101, and the curved portion 105*b* of the rotatable member 105 is moved to the position of the column portion 101*b* of the contact member 101. At that time, since the contact member 101 is biased in the arrow rotational direction Qb by the torsion spring 103, the column portion 101*b* of the contact member 101 is guided into the curved portion 105*b* of the rotatable member 105, the contact member 101 is rotated in the arrow rotational direction Qb, the column portion 101*b* is brought into contact with the inner edge of the curved portion 105*b*, so that the contact member 101 is positioned, and the rectangular plate 101*c* of the contact member 101 is rotated downward to be lower than the horizontal direction. Furthermore, the blocking piece 101*f* on the shaft portion 101*a* is rotated in the arrow rotational direction Qb, and passes through a point between the light-emitting element 104*a* and the light-receiving element 104*b* of the optical sensor 104.

Subsequently, when the paper stacking shelf 74 is lifted, thereby causing the trailing edge portion of the upper face of the paper bundle to be brought into contact with the rollers 101*e* of the contact member 101 and to push up the contact member 101, the rectangular plate 101*c* of the contact member 101 is lifted to be slightly at an angle and higher than the horizontal direction. Furthermore, the blocking piece 101*f* on the shaft portion 101*a* is rotated in the arrow rotational direction Qa, and enters between the light-emitting element 104*a* and the light-receiving element 104*b* of the optical sensor 104, and is thus detected by the optical sensor 104. Then, in response to the detection output from the optical sensor 104 at that time, the lifting of the paper stacking shelf 74 is stopped.

Next, when the paper feed device 71 is pulled out again, the other end 106*b* of the rod 106 is moved away from the main body frame 14*a* of the large capacity cassette 14, and, thus, the rotatable member 105 is biased and rotated in the arrow rotational direction Sa by the coil spring 107 until the rotatable member 105 is brought into contact with the stopper 108 as shown in FIGS. 10 (*a*), 10 (*b*), 12, and 13. Thus, the end 106*a* of the rod 106 is pushed by the elongated recess portion 105*d* of the rotatable member 105 in the arrow direction Ma, and the rod 106 is moved in the arrow direction Ma. At the same time, the column portion 101*b* of the contact member 101 is rotated and pushed up in the arrow rotational direction Qa by the arm portion 105*c* of the rotatable member 105 resisting the biasing force of the torsion spring 103 in the arrow rotational direction Qb. That is, the force of the coil spring 107 and the rotatable member 105 that push up the contact member 101 in the arrow rotational direction Qa is greater than the force of the torsion spring 103 that biases the contact member 101 in the arrow rotational direction Qb. As a result, the rectangular plate 101*c* of the contact member 101 is oriented upward substantially to the vertical direction so as to be withdrawn, and the blocking piece 101*f* on the shaft portion 101*a* is projected in the drawing-out direction (the front side) E, and is moved away from the optical sensor 104.

Subsequently, in a similar manner, when the paper feed device 71 is pushed in, the rectangular plate 101*c* of the contact member 101 is rotated downward to be lower than the horizontal direction, and the blocking piece 101*f* on the shaft portion 101*a* passes through a point between the light-emitting element 104*a* and the light-receiving element 104*b* of the optical sensor 104. Then, when the paper stacking shelf 74 is lifted, thereby causing the trailing edge portion of the upper face of the paper bundle to push up the contact member 101, the rectangular plate 101*c* of the contact member 101 is lifted to be slightly at an angle and higher than the horizontal direction. Thus, the blocking piece 101*f* on the shaft portion 101*a* is detected by the optical sensor 104, and the lifting of the paper stacking shelf 74 is stopped. Furthermore, when the paper feed device 71 is pulled out, the rectangular plate 101*c* of the contact member 101 is oriented upward substantially to the vertical direction so as to be withdrawn. Thus, the blocking piece 101*f* on the shaft portion 101*a* is projected in the drawing-out direction (the front side) E, and is moved away from the optical sensor 104.

Accordingly, in the state in which the paper feed device 71 is pulled out, the rectangular plate 101*c* of the contact member 101 is oriented upward substantially to the vertical direction so as to be withdrawn, and a paper bundle can be immediately supplied to the paper stacking shelf 74 without being caught on the contact member 101.

Furthermore, immediately after the paper feed device 71 has been pushed in, the rectangular plate 101*c* of the contact member 101 is rotated downward to be lower than the horizontal direction. Then, when the paper stacking shelf 74 is lifted, thereby causing the trailing edge portion of the upper face of the paper bundle to push up the contact member 101, the rectangular plate 101*c* of the contact member 101 is lifted to be slightly at an angle and higher than the horizontal direction, and the lifting of the paper stacking shelf 74 is stopped, so that the contact member 101 prevents the trailing edge portion of the recording papers in the paper bundle from moving upward. The position of the contact member 101 when the rectangular plate 101*c* of the contact member 101 has been lifted to be slightly at an angle and higher than the horizontal direction is an optimum contact position for causing an uppermost sheet of recording paper in the paper bundle to adhere to the surfaces of the paper transport belts 81.

The position of the contact member 101 when the rectangular plate 101*c* of the contact member 101 has been lifted to be slightly at an angle and higher than the horizontal direction is referred to as a contact position. In the description below, positions other than the contact position will be also described, that is, the position of the contact member 101 when the rectangular plate 101*c* of the contact member 101 has been oriented upward substantially to the vertical direction so as to be withdrawn is referred to as a withdrawn away position, and the position of the contact member 101 when the rectangular plate 101*c* of the contact member 101 has been rotated downward to be lower than the horizontal direction is referred to as a standby position.

Next, the positional relationship between the blocking piece 101*f* of the contact member 101 and the optical sensor 104 at the withdrawn away position, the standby position, and the contact position will be described with reference to FIGS. 16 (*a*), 16 (*b*), and 16 (*c*).

Figure 16:
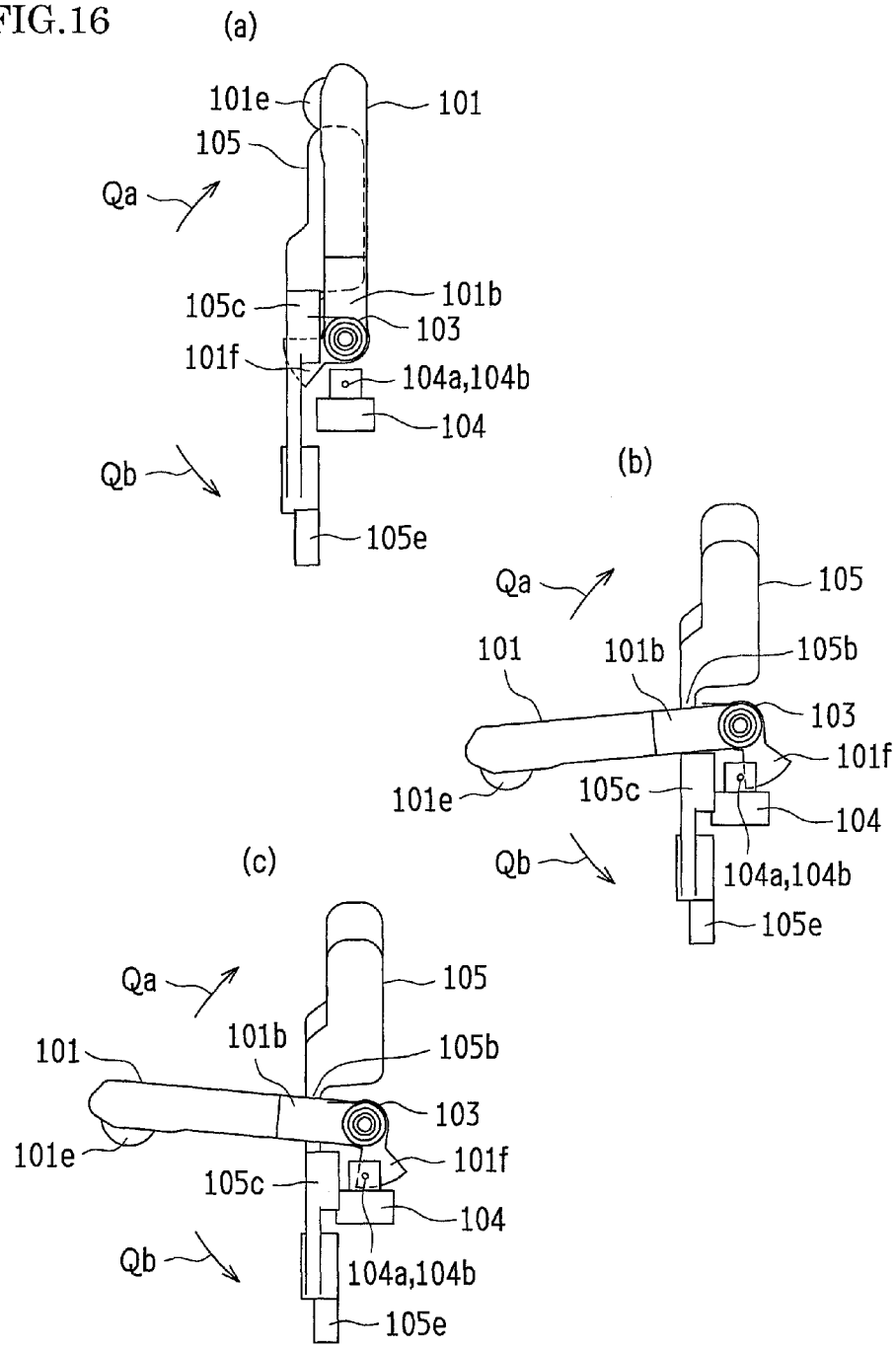
FIGS. 16 (*a*), 16 (*b*), and 16 (*c*) are side views showing positional relationships between a blocking piece of the contact member and an optical sensor at a withdrawn position, a standby position, and a contact position.

When the rectangular plate 101*c* of the contact member 101 has been oriented upward substantially to the vertical direction so as to be withdrawn as shown in FIG. 16 (*a*), the rectangular plate 101*c* is at the withdrawn away position, and the blocking piece 101*f* of the contact member 101 is projected in the drawing-out direction (the front side) E, and is away from a point between the light-emitting element 104*a* and the light-receiving element 104*b* of the optical sensor 104. Accordingly, the blocking piece 101*f* is not detected by the optical sensor 104.

Furthermore, when the column portion 101*b* of the contact member 101 has been brought into contact with the inner edge of the curved portion 105*b*, and the rectangular plate 101*c* of the contact member 101 has been rotated downward to be lower than the horizontal direction as shown in FIG. 16 (*b*), the contact member 101 is at the standby position, and the blocking piece 101*f* of the contact member 101 is away from a point between the light-emitting element 104*a* and the light-receiving element 104*b* of the optical sensor 104. Accordingly, the blocking piece 101*f* is not detected by the optical sensor 104.

Furthermore, when the rectangular plate 101*c* of the contact member 101 has been lifted to be slightly at an angle and higher than the horizontal direction as shown in FIG. 16 (*c*), the contact member 101 is at the contact position, and the blocking piece 101*f* of the contact member 101 is between the light-emitting element 104*a* and the light-receiving element 104*b* of the optical sensor 104. Accordingly, the blocking piece 101*f* is detected by the optical sensor 104.

Accordingly, based on the detection output from the optical sensor 104, it is possible to determine whether the contact member 101 is at the contact position, or at either the withdrawn away position or the standby position.

Figure 17:
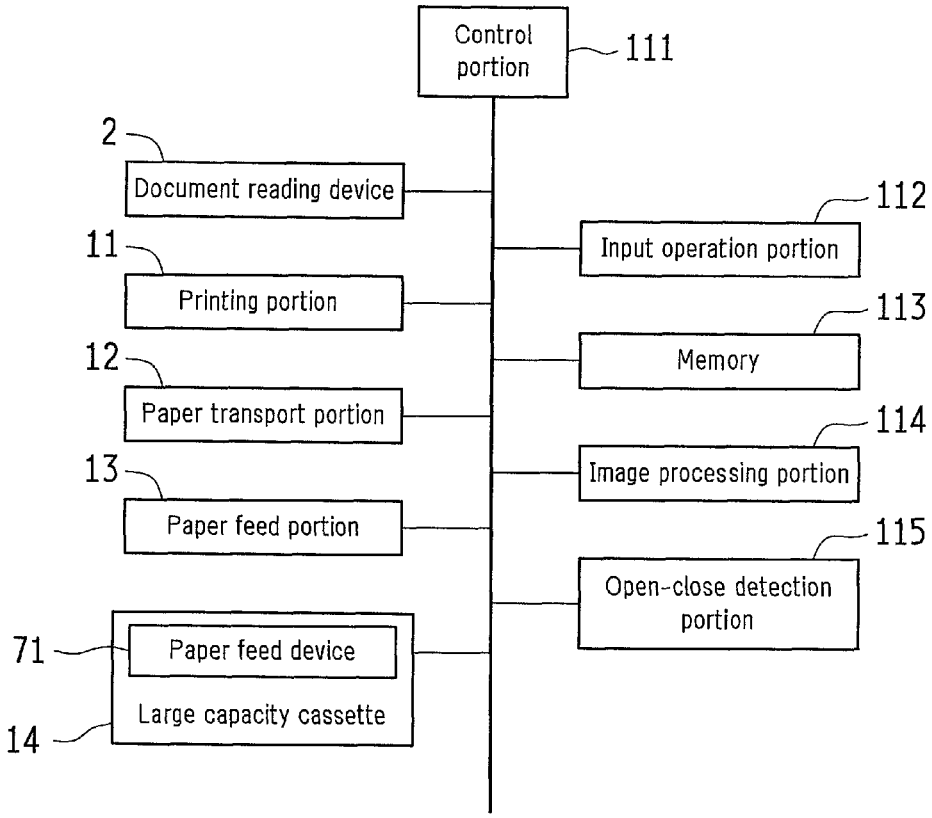
FIG. 17 is a block diagram schematically showing a control system of the paper feed device.

Next, the control of the paper feed device 71 will be described. FIG. 17 is a block diagram schematically showing a control system of the paper feed device 71. In FIG. 17, a control portion 111 is for performing overall control of the image forming apparatus 1, the paper feed device 71, and the like, and is configured by a CPU, a RAM, a ROM, various interfaces, and the like. An input operation portion 112 is provided with, for example, a plurality of operation keys, a crystal display device, a touch panel that is superimposed on the screen of the crystal display device, and the like, and causes operation guidance and the like of the image forming apparatus 1 to be displayed on the screen of the crystal display device, or data or the like input or designated through operations on the operation keys or the like to be output to the control portion 111. A memory 113 is, for example, a hard disk drive (HDD), and stores various types of data and programs. An image processing portion 114 performs various types of image processing on image data.

An open-close detection portion 115 detects whether the paper feed device 71 is being pulled out from or pushed into the accommodation space inside the main body of the large capacity cassette 14, and outputs the detect result to the control portion 111.

In this sort of configuration, for example, the control portion 111 performs control so that a document image is read by the document reading device 2, image data indicating the document image is stored in the memory 113, the image data in the memory 113 is processed by the image processing portion 114, and the document image indicated by the image data in the memory 113 is recorded by the printing portion 11 on a recording paper.

Furthermore, if the paper feed portion 13 is selected by operating the input operation portion 112, in response to this selection, the control portion 111 controls the paper feed portion 13 so that a recording paper is fed from the paper feed portion 13 to the printing portion 11 and the document image is recorded on this recording paper.

Alternatively, if the large capacity cassette 14 is selected by operating the input operation portion 112, the control portion 111 controls the paper feed device 71 of the large capacity cassette 14 so that a recording paper is fed from the paper feed device 71 to the printing portion 11 and the document image is recorded on this recording paper.

Furthermore, when the paper feed device 71 is pulled out from and pushed into the accommodation space inside the main body of the large capacity cassette 14 in order to supply a paper bundle to the paper feed device 71, the following control is performed, and the withdrawn away position, the standby position, and the contact position of the contact member 101 are sequentially set.

First, when the paper feed device 71 is pulled out from the accommodation space inside the main body of the large capacity cassette 14, the open-close detection portion 115 detects that the paper feed device 71 is being pulled out. When the open-close detection portion 115 detects that the paper feed device 71 is being pulled out, the control portion 111 starts to rotationally drive the pulse motor 92 so as to lower the paper stacking shelf 74 to the lower limit position. Furthermore, in conjunction with the operation that pulls out the paper feed device 71, the rectangular plate 101*c* of the contact member 101 is moved to the withdrawn away position as shown in FIG. 16 (*a*), and, thus, the blocking piece 101*f* is no more detected by the optical sensor 104.

As described above, at the same time that the paper feed device 71 is pulled out, the rectangular plate 101*c* of the contact member 101 is oriented upward substantially to the vertical direction so as to be moved to the withdrawn away position, and, thus, even when the paper stacking shelf 74 has not yet reached the lower limit position, the operation that supplies a paper bundle to the paper stacking shelf 74 can be started. Furthermore, after the paper stacking shelf 74 has reached the lower limit position, a paper bundle can be sufficiently supplied until the height of the paper bundle reaches an allowable limit.

After the operation that supplies a paper bundle to the paper stacking shelf 74 has been performed in this manner, when the paper feed device 71 is pushed into the accommodation space inside the main body of the large capacity cassette 14, the open-close detection portion 115 detects that the paper feed device 71 is being pushed in. When the open-close detection portion 115 detects that the paper feed device 71 is being pushed in, the control portion 111 rotates the pulse motor 92 in reverse so as to lift the paper stacking shelf 74.

Immediately after the paper feed device 71 has been pushed in, as shown in FIG. 16 (*b*), the rectangular plate 101*c* of the contact member 101 is rotated downward substantially to the horizontal direction so as to be moved to the standby position, so that the rectangular plate 101*c* comes to oppose the upper face of the paper bundle on the paper stacking shelf 74, and the blocking piece 101*f* is no more detected by the optical sensor 104. In this state, when the upper face of the paper bundle is lifted, the trailing edge portion of the upper face of the paper bundle is brought into contact with the rollers 101*e* of the contact member 101 and pushes up the contact member 101. As the contact member 101 is being pushed up, the rectangular plate 101*c* of the contact member 101 is moved to the contact position as shown in FIG. 16 (*c*), and the blocking piece 101*f* is detected by the optical sensor 104. In response to the detection output from the optical sensor 104 that has detected the blocking piece 101*f*, the control portion 111 stops the pulse motor 92 so that the uppermost sheet of recording paper in the paper bundle is positioned at the contact position of the contact member 101. Accordingly, the uppermost sheet of recording paper in the paper bundle is positioned at an optimum contact position for adhesion to the surfaces of the paper transport belts 81. Furthermore, the rollers 101*e* of the contact member 101 are brought into contact with the trailing edge portion of the upper face of the paper bundle, and the trailing edge portion of the recording papers in the paper bundle is prevented from moving upward.

Furthermore, the rollers 101*e* of the contact member 101 are spaced apart from each other in a direction orthogonal to the drawing-out direction E. Accordingly, it can be assured that the length across which the contact member 101 is in contact with the upper face of the paper bundle in the direction orthogonal to the drawing-out direction E is longer than the length across which the contact member 101 is in contact with the upper face of the paper bundle in the drawing-out direction E. Accordingly, positions respectively near both sides of the trailing edge portion of the paper bundle can be pressed down, and, thus, the trailing edge portion of the recording papers in the paper bundle can be effectively prevented from moving upward.

Furthermore, since the rollers 101*e* of the contact member 101 prevent the trailing edge portion of the recording papers in the paper bundle from moving upward, the trailing edge portion of the uppermost sheet of recording paper in the paper bundle can be stably and accurately positioned at the contact position with the contact member 101. Accordingly, the height of the upper face of the paper bundle can be accurately detected by the optical sensor 104.

Subsequently, as described above, air from the exhaust openings 77*a* and 78*a* of the assist ducts 77 and 78 and air from the exhaust openings 86*b* of the exhaust duct 86 are blown against end faces of the paper bundle on the paper stacking shelf 74, and, in this state, a recording paper in the paper bundle is drawn out and transported while being caused to adhere to the surfaces of the paper transport belts 81. When a recording paper is drawn out by the paper transport belts 81, the rollers 101*e* of the contact member 101 are rotated in contact with the recording paper, and, thus, friction between the rollers 101*e* and the recording paper is small, and the recording paper can be easily drawn out. Furthermore, since the resistance on the recording paper is smallest when the recording paper is moving in a direction orthogonal to the shafts of the rollers 101*e*, the movement direction of the recording paper is regulated by the rollers 101*e* into the drawing-out direction E, and, thus, tilting of the recording paper is prevented.

When recording papers are repeatedly drawn out from the paper bundle in this manner, the height of the paper bundle is reduced. At that time, the rectangular plate 101*c* is rotated in the arrow rotational direction Qb and is moved away from the contact position, and, thus, the blocking piece 101*f* is no more detected by the optical sensor 104, and the detection output from the optical sensor 104 changes. In response to the change in the detection output from the optical sensor 104, the control portion 111 again starts to rotate the pulse motor 92 so as to lift the paper stacking shelf 74. Accordingly, the upper face of the paper bundle pushes up the contact member 101, the rectangular plate 101*c* is moved to the contact position as shown in FIG. 16 (*c*), and the blocking piece 101*f* is detected again by the optical sensor 104. In response to this detection, the pulse motor 92 is stopped, so that the uppermost sheet of recording paper in the paper bundle is positioned at an optimum contact position for adhesion to the surfaces of the paper transport belts 81.

Subsequently, in a similar manner, when the height of the paper bundle is reduced and the blocking piece 101*f* is detected no more by the optical sensor 104, the paper stacking shelf 74 is lifted until the blocking piece 101*f* is detected again, and, thus, the uppermost sheet of recording paper in the paper bundle is positioned at the contact position.

In this manner, in this embodiment, when the paper feed device 71 is pulled out, the rectangular plate 101*c* of the contact member 101 is oriented upward substantially to the vertical direction so as to be moved to the withdrawn away position, and, thus, a paper bundle can be immediately supplied to the paper stacking shelf 74 without being caught on the contact member 101. Furthermore, when the paper feed device 71 is pushed in, the rectangular plate 101*c* of the contact member 101 is rotated downward substantially to the horizontal direction so as to be moved to the standby position, and the rectangular plate 101*c* comes to oppose the upper face of the paper bundle on the paper stacking shelf 74. In this state, when the paper stacking shelf 74 is lifted, thereby causing the trailing edge portion of the upper face of the paper bundle to be brought into contact with the rollers 101*e* of the contact member 101 and to lift the rectangular plate 101*c* of the contact member 101 to the contact position, the paper stacking shelf 74 is stopped in response to the detection output from the optical sensor 104, and, thus, the uppermost sheet of recording paper in the paper bundle is positioned at an optimum contact position for adhesion to the surfaces of the paper transport belts 81. Furthermore, the contact with the contact member 101 prevents the trailing edge portion of the recording papers in the paper bundle from moving upward.

Note that, in the foregoing embodiment, a recording paper is transported while being caused to adhere to the paper transport belts 81, but the present invention can be also applied to a paper feed device in which a pickup roller is pressed against an uppermost sheet of recording paper in a paper bundle, and recording paper is drawn out and transported by rotating the pickup roller.

Above, a preferred embodiment of the present invention was described with reference to the appended drawings, but of course the invention is not limited by those examples. It will be clear to those skilled in the art that within the range described in the claims, various modified or revised examples can be arrived at, and it will be understood that such examples also are naturally encompassed by the technical scope of the invention.

What is claimed is:

1. A paper feed device, comprising:

a paper stacking shelf on which a paper bundle is to be stacked;

a position regulating portion that regulates a position of the paper bundle by being brought into contact with an edge of the paper bundle;

a contact member that is disposed on the position regulating portion; and a position switch portion that moves the contact member to either a withdrawn away position or a contact position with respect to an upper face of the paper bundle; and a sensor that detects whether or not the upper face of the paper bundle has reached the contact position, wherein the paper feed device is pulled out from and pushed into an accommodation space for accommodating the paper feed device, the position switch portion is provided with a movable member that is moved in conjunction with an operation for causing the paper feed device to be pulled out from and pushed into the accommodation space, and a rotatable member that is rotated in conjunction with the movement of the movable member, and the position switch portion supports the contact member in a rotatable manner, and causes the contact member to be rotationally moved to either the withdrawn away position or the contact position with respect to the upper face of the paper bundle in conjunction with the rotation of the rotatable member.

2. The paper feed device according to claim 1, wherein the rotatable member has a curved portion and an arm portion, when the movable member is moved and the rotatable member is rotated in conjunction with an operation for causing the paper feed device to be pushed into the accommodation space, the contact member is guided into the curved portion of the rotatable member, and is rotated in a rotational direction to the contact position, and a rotational position of the contact member is regulated by the curved portion of the rotatable member, and when the movable member is moved and the rotatable member is rotated in conjunction with an operation for causing the paper feed device to be pulled out from the accommodation space, the contact member is pushed up by the arm portion of the rotatable member, and is rotated to the withdrawn away position.

3. The paper feed device according to claim 2, further comprising a vertical movement drive portion that vertically moves the paper stacking shelf, thereby moving the upper face of the paper bundle to the contact position, wherein the contact position is located closer to the withdrawn away position than is the position to which the contact member has been rotated through regulation by the curved portion of the rotatable member.

4. The paper feed device according to claim 3, further comprising a control portion that keeps the vertical movement drive portion in operation to lift the paper stacking shelf until the sensor detects that the upper face of the paper bundle has reached the contact position.

5. The paper feed device according to claim 1, further comprising a biasing member that biases the rotatable member, in a rotational direction of the rotatable member for moving the contact member to the withdrawn away position.

6. The paper feed device according to claim 1, further comprising:

a first biasing member that biases the contact member in a rotational direction to the contact position; and a second biasing member that biases the rotatable member, in a rotational direction of the rotatable member for moving the contact member to the withdrawn away position.

7. The paper feed device according to claim 1, wherein the movable member is moved upon contact with a member that is disposed in the accommodation space when the paper feed device is pushed into the accommodation space.

8. The paper feed device according to claim 1, wherein the movable member is a rod-like member that is linearly moved in conjunction with an operation for causing the paper feed device to be pulled out from and pushed into the accommodation space, the rotatable member has an elongated recess portion that receives one edge portion of the rod-like member, and the elongated recess portion is pushed by the one edge portion of the rod-like member, so that the rotatable member is rotated.

9. The paper feed device according to claim 1, wherein a length across which the contact member is in contact with the upper face of the paper bundle in a direction orthogonal to a transport direction of paper in the paper bundle is longer than a length across which the contact member is in contact with the upper face of the paper bundle in the transport direction.

10. The paper feed device according to claim 1, wherein the contact member is provided with a roller that is brought into contact with the upper face of the paper bundle.

11. The paper feed device according to claim 1, wherein the contact member is brought into contact with a trailing edge portion of the upper face of the paper bundle, the trailing edge portion being oriented in a direction opposite to a paper transport direction of paper in the paper bundle.

12. The paper feed device according to claim 1, further comprising:

an end face air blow portion that blows air against an end face of the paper bundle; and a paper transport member that transports paper in the paper bundle in a state where the paper adheres thereto due to suction of air;

wherein the contact member is brought into contact with a trailing edge portion of the upper face of the paper bundle.

13. An image forming apparatus comprising the paper feed device according to claim 1.

14. A paper feed device, comprising:

a paper stacking shelf on which a paper bundle is to be stacked;

a position regulating portion that regulates a position of the paper bundle by being brought into contact with an edge of the paper bundle;

a contact member that is disposed on the position regulating portion; and a position switch portion that moves the contact member to either a withdrawn away position or a contact position with respect to an upper face of the paper bundle;

wherein the paper feed device is pulled out from and pushed into an accommodation space for accommodating the paper feed device, the position switch portion is provided with a movable member that is linearly moved, with respect to the position regulating portion, in conjunction with an operation for causing the paper feed device to be pulled out from and pushed into the accommodation space, and a rotatable member that is rotated in conjunction with the movement of the movable member, the position switch portion supports the contact member in a rotatable manner, and causes the contact member to rotate in conjunction with the rotation of the rotatable member, when the movable member is moved in a first linear direction, with respect to the position regulating portion, in conjunction with the operation for causing the paper feed device to be pulled out from the accommodation space, and when the rotatable member is rotated about an axis provided on the rotatable member in conjunction with the movement of the movable member, the contact member is rotated to the withdrawn away position in conjunction with the rotation of the rotatable member, and when the movable member is moved in a second linear direction, with respect to the position regulating portion, in conjunction with the operation for causing the paper feed device to be pushed into the accommodation space, and when the rotatable member is rotated about the axis provided on the rotatable member in conjunction with the movement of the movable member, the contact member is rotated to the contact position in conjunction with the rotation of the rotatable member.

15. The paper feed device according to claim 14, wherein directions in which the paper feed device is pulled out from and pushed into the accommodation space are the same as the movement directions of the movable member.

16. The paper feed device according to claim 14, further comprising:

a first biasing member that biases the contact member in a rotational direction to the contact position; and a second biasing member that biases the rotatable member, in a rotational direction of the rotatable member for moving the contact member to the withdrawn away position.

17. The paper feed device according to claim 14, wherein the contact member is brought into contact with a trailing edge portion of the upper face of the paper bundle, the trailing edge portion being oriented in a direction opposite to a paper transport direction of paper in the paper bundle.

18. The paper feed device according to claim 14, further comprising a sensor that detects whether or not the upper face of the paper bundle has reached the contact position.

19. The paper feed device according to claim 14, further comprising:

a sensor that detects whether or not the upper face of the paper bundle has reached the contact position;

a vertical movement drive portion that vertically moves the paper stacking shelf, thereby moving the upper face of the paper bundle to the contact position; and a control portion that keeps the vertical movement drive portion in operation to lift the paper stacking shelf until the sensor detects that the upper face of the paper bundle has reached the contact position, wherein the contact position is located closer to the withdrawn away position than is the position to which the contact member has been rotated through regulation by the curved portion of the rotatable member, wherein the rotatable member has a curved portion and an arm portion, when the movable member is moved and the rotatable member is rotated in conjunction with an operation for causing the paper feed device to be pushed into the accommodation space, the contact member is guided into the curved portion of the rotatable member, and is rotated in a rotational direction to the contact position, and a rotational position of the contact member is regulated by the curved portion of the rotatable member, and when the movable member is moved and the rotatable member is rotated in conjunction with an operation for causing the paper feed device to be pulled out from the accommodation space, the contact member is pushed up by the arm portion of the rotatable member, and is rotated to the withdrawn away position.

20. The paper feed device according to claim 14, further comprising:

an end face air blow portion that blows air against an end face of the paper bundle; and a paper transport member that transports paper in the paper bundle in a state where the paper adheres thereto due to suction of air;

wherein the contact member is brought into contact with a trailing edge portion of the upper face of the paper bundle.

21. An image forming apparatus comprising the paper feed device according to claim 14.

22. The paper feed device according to claim 1, wherein directions in which the paper feed device is pulled out from and pushed into the accommodation space are the same as the movement directions of the movable member.

23. A paper feed device, comprising:

a paper stacking shelf on which a paper bundle is to be stacked;

a position regulating portion that regulates a position of the paper bundle by being brought into contact with an edge of the paper bundle;

a contact member that is disposed on the position regulating portion; and a position switch portion that moves the contact member to either a withdrawn away position or a contact position with respect to an upper face of the paper bundle;

wherein the paper feed device is pulled out from and pushed into an accommodation space for accommodating the paper feed device, the position switch portion is provided with a movable member that is moved in conjunction with an operation for causing the paper feed device to be pulled out from and pushed into the accommodation space, and a rotatable member that is rotated in conjunction with the movement of the movable member, and the position switch portion supports the contact member in a rotatable manner, and causes the contact member to be rotationally moved to either the withdrawn away position or the contact position with respect to the upper face of the paper bundle in conjunction with the rotation of the rotatable member, wherein the movable member is a rod-like member that is linearly moved in conjunction with an operation for causing the paper feed device to be pulled out from and pushed into the accommodation space, the rotatable member has an elongated recess portion that receives one edge portion of the rod-like member, and the elongated recess portion is pushed by the one edge portion of the rod-like member, so that the rotatable member is rotated.

24. An image forming apparatus comprising the paper feed device according to claim 23.

25. A paper feed device, comprising:

a paper stacking shelf on which a paper bundle is to be stacked;

a position regulating portion that regulates a position of the paper bundle by being brought into contact with an edge of the paper bundle;

a contact member that is disposed on the position regulating portion; and a position switch portion that moves the contact member to either a withdrawn away position or a contact position with respect to an upper face of the paper bundle;

wherein the paper feed device is pulled out from and pushed into an accommodation space for accommodating the paper feed device, the position switch portion is provided with a movable member that is moved in conjunction with an operation for causing the paper feed device to be pulled out from and pushed into the accommodation space, and a rotatable member that is rotated in conjunction with the movement of the movable member, and the position switch portion supports the contact member in a rotatable manner, and causes the contact member to be rotationally moved to either the withdrawn away position or the contact position with respect to the upper face of the paper bundle in conjunction with the rotation of the rotatable member, wherein the rotatable member has a curved portion and an arm portion, when the movable member is moved and the rotatable member is rotated in conjunction with an operation for causing the paper feed device to be pushed into the accommodation space, the contact member is guided into the curved portion of the rotatable member, and is rotated in a rotational direction to the contact position, and a rotational position of the contact member is regulated by the curved portion of the rotatable member, and when the movable member is moved and the rotatable member is rotated in conjunction with an operation for causing the paper feed device to be pulled out from the accommodation space, the contact member is pushed up by the arm portion of the rotatable member, and is rotated to the withdrawn away position.

26. An image forming apparatus comprising the paper feed device according to claim 25.

* * * * *